US008556266B2

(12) United States Patent
Yoshida

(10) Patent No.: US 8,556,266 B2
(45) Date of Patent: Oct. 15, 2013

(54) CARD HAVING DOT PATTERNS

(76) Inventor: Kenji Yoshida, Tokyo (JP)

( * ) Notice: Subject to any disclaimer, the term of this patent is extended or adjusted under 35 U.S.C. 154(b) by 408 days.

(21) Appl. No.: 12/521,669

(22) PCT Filed: Dec. 28, 2007

(86) PCT No.: PCT/JP2007/075426

§ 371 (c)(1),
(2), (4) Date: Jun. 29, 2009

(87) PCT Pub. No.: WO2008/082002

PCT Pub. Date: Jul. 10, 2008

(65) Prior Publication Data

US 2010/0276887 A1 Nov. 4, 2010

(30) Foreign Application Priority Data

Dec. 28, 2006 (JP) ..... 2006-356469

(51) Int. Cl.
*A63F 9/24* (2006.01)
*G06K 7/14* (2006.01)

(52) U.S. Cl.
USPC ..... 273/293; 235/462.01

(58) Field of Classification Search
USPC ..... 273/289, 292, 293, 308, 309; 235/444, 235/462.01, 468
See application file for complete search history.

(56) References Cited

U.S. PATENT DOCUMENTS 4,322,001 A * 3/1982 Hurley ..... 206/449
5,259,907 A * 11/1993 Soules et al. ..... 156/277
5,896,403 A * 4/1999 Nagasaki et al. ..... 714/752
5,897,669 A * 4/1999 Matsui ..... 235/462.07
5,921,584 A * 7/1999 Goade, Sr. ..... 283/107
6,047,880 A * 4/2000 Petkovsek ..... 229/92.8
6,088,345 A 7/2000 Sakoda
6,267,296 B1 * 7/2001 Ooshima et al. ..... 235/487
6,530,836 B2 * 3/2003 Soltys et al. ..... 463/29
6,570,104 B1 * 5/2003 Ericson et al. ..... 178/18.09
6,595,857 B2 * 7/2003 Soltys et al. ..... 463/29
6,771,355 B2 * 8/2004 Ishii et al. ..... 355/72
6,864,880 B2 * 3/2005 Hugosson et al. ..... 345/162
6,899,333 B2 * 5/2005 Weisman ..... 273/289
7,316,615 B2 * 1/2008 Soltys et al. ..... 463/25
7,344,086 B2 * 3/2008 Grossman et al. ..... 235/487
7,431,297 B2 * 10/2008 Kaji et al. ..... 273/237
7,661,676 B2 * 2/2010 Smith et al. ..... 273/149 R
7,762,889 B2 * 7/2010 Shigeta ..... 463/29
7,771,272 B2 * 8/2010 Soltys et al. ..... 463/25
RE41,925 E * 11/2010 Warther ..... 283/61

(Continued)

FOREIGN PATENT DOCUMENTS

JP 2005-261645 A 9/2005
JP 2005-284103 A 10/2005
JP 2006-338690 A 12/2006

*Primary Examiner* — William Pierce
(74) *Attorney, Agent, or Firm* — Smith Patent Office

(57) ABSTRACT

A flexible card which allows data of the card to be changed with a simple operation is provided, thereby permitting users to sustain interest in the card and a relevant game. The card comprises a first dot pattern in which a coordinate value or a code value is patterned and which is recognizable by predetermined irradiation light at least on one surface thereof and a second dot pattern which is patterned in a predetermined algorithm in a region overlapping with a region where the first dot pattern is provided or a region different from a region where the first dot pattern is provided.

23 Claims, 21 Drawing Sheets

(56) References Cited

U.S. PATENT DOCUMENTS

| | | | | |
|---|---|---|---|---|
| 7,967,217 | B2 * | 6/2011 | Yoshida | 235/494 |
| 7,982,904 | B2 * | 7/2011 | Silverbrook et al. | 358/1.18 |
| 7,991,220 | B2 * | 8/2011 | Nagai et al. | 382/154 |
| 8,016,663 | B2 * | 9/2011 | Soltys et al. | 463/22 |
| 8,020,869 | B2 * | 9/2011 | Kaji et al. | 273/244.2 |
| 8,027,508 | B2 * | 9/2011 | Rhoads et al. | 382/100 |
| 2003/0009725 | A1 * | 1/2003 | Reichenbach | 714/804 |
| 2003/0171142 | A1 | 9/2003 | Kaji | |
| 2006/0249588 | A1 * | 11/2006 | Walmsley et al. | 235/494 |
| 2008/0132305 | A1 * | 6/2008 | Kaji et al. | 463/11 |
| 2009/0321521 | A1 * | 12/2009 | Takano et al. | 235/462.11 |
| 2010/0302171 | A1 * | 12/2010 | Yoshida | 345/173 |
| 2011/0049234 | A1 * | 3/2011 | Yoshida | 235/380 |
| 2011/0109641 | A1 * | 5/2011 | Yoshida | 345/589 |
| 2011/0127331 | A1 * | 6/2011 | Zhao et al. | 235/462.01 |
| 2011/0188071 | A1 * | 8/2011 | Yoshida | 358/1.15 |

* cited by examiner

FIG. 6A
00100001
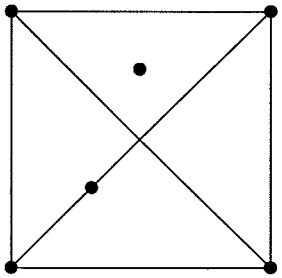
FIG. 6B
00100001
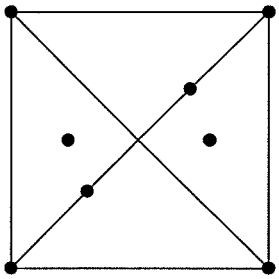
FIG. 6C
00100001
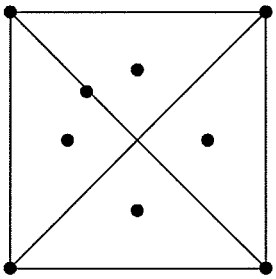
FIG. 7A
| | | |
|---|---|---|
| $I_3$ | $I_4$ | $I_5$ |
| $I_2$ | $I_1$ | $I_6$ |
2× 3
FIG. 7B
| | | |
|---|---|---|
| $I_3$ | $I_4$ | $I_5$ |
| $I_2$ | $I_1$ | $I_6$ |
| $I_9$ | $I_8$ | $I_7$ |
3× 3
FIG. 7C
| | | |
|---|---|---|
| $I_5$ | $I_6$ | $I_7$ |
| $I_4$ | $I_1$ | $I_8$ |
| $I_3$ | $I_2$ | $I_9$ |
| $I_{12}$ | $I_{11}$ | $I_{10}$ |
3× 4
FIG. 7D
| | | | | | |
|---|---|---|---|---|---|
| $I_{36}$ | $I_{17}$ | $I_{18}$ | $I_{19}$ | $I_{20}$ | $I_{21}$ |
| $I_{35}$ | $I_{16}$ | $I_5$ | $I_6$ | $I_7$ | $I_{22}$ |
| $I_{34}$ | $I_{15}$ | $I_4$ | $I_1$ | $I_8$ | $I_{23}$ |
| $I_{33}$ | $I_{14}$ | $I_3$ | $I_2$ | $I_9$ | $I_{24}$ |
| $I_{32}$ | $I_{13}$ | $I_{12}$ | $I_{11}$ | $I_{10}$ | $I_{25}$ |
| $I_{31}$ | $I_{30}$ | $I_{29}$ | $I_{28}$ | $I_{27}$ | $I_{26}$ |
6× 6

DOTS DIFFER BETWEEN FRONT AND BACK SURFACES. THEREFORE, COMBINATIONS ARE 16x16=256 PATTERNS.

IF TWO OF THESE STICKERS ARE USED FOR A CARD HAVING TWO NOTCHES, COMBINATIONS ARE 256x 256=65536 PATTERNS.

FIG. 18A THREE STRIPS ARE OVERLAID
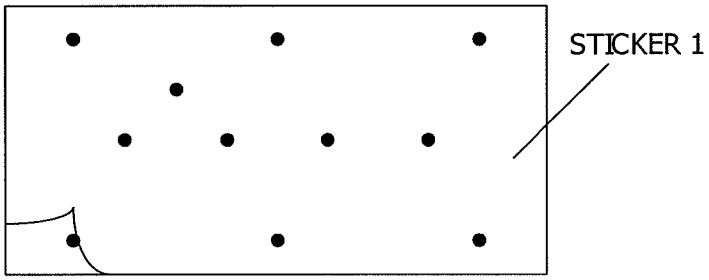
FIG. 18B ONE STRIP IS PEELED OFF
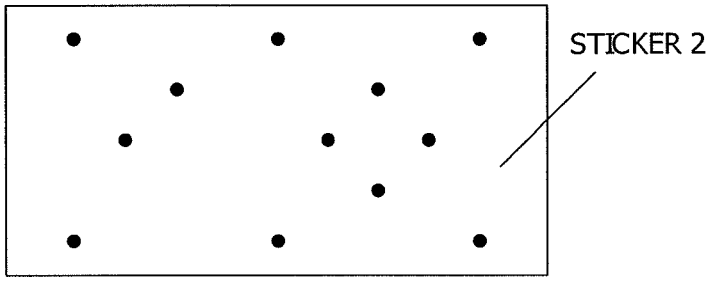
FIG. 18C ANOTHER STRIP IS PEELED OFF
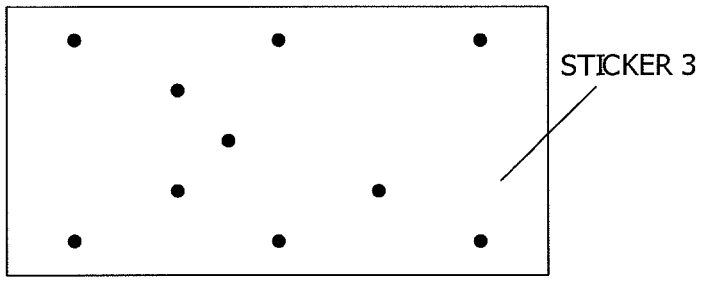

FIG. 23A INCREASING THE NUMBER OF DOTS
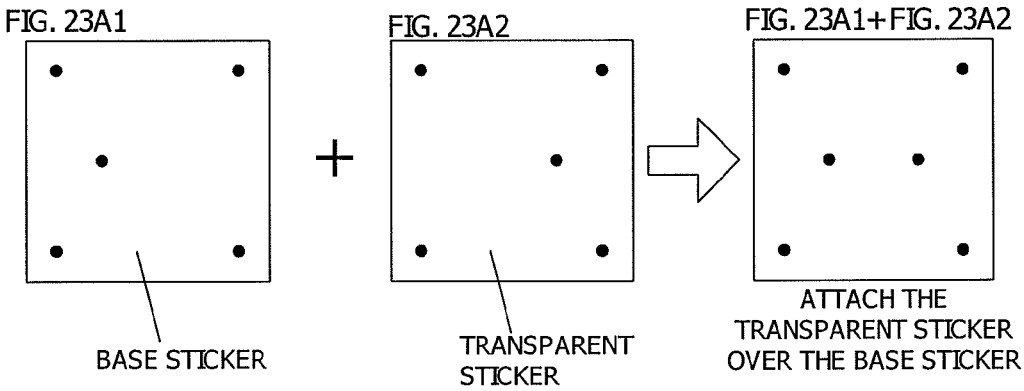
FIG. 23B DECREASING THE NUMBER OF DOTS
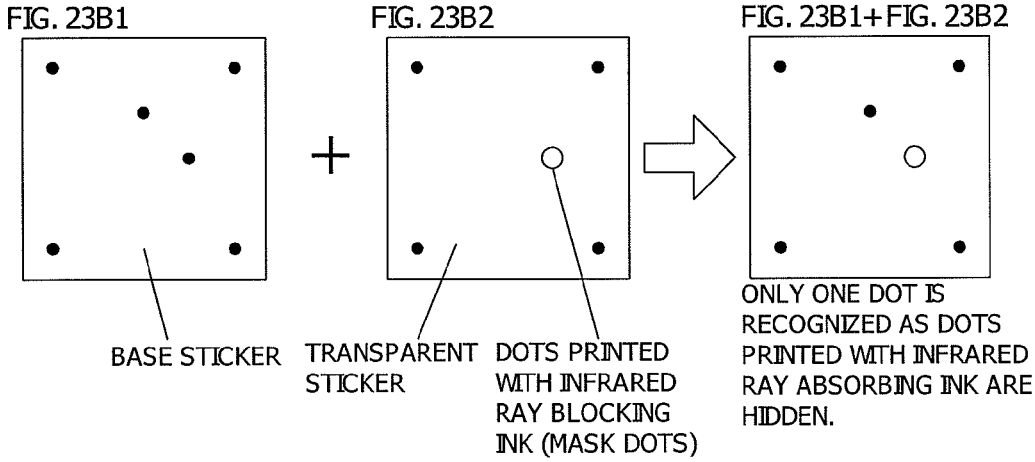
FIG. 23C COMBINATION OF FIGS. 23A1-23A3 AND 23B1-23B3
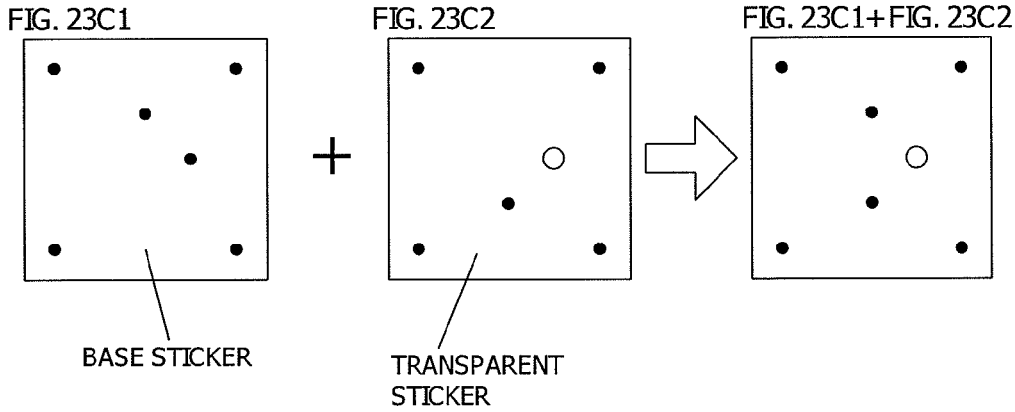

CARD HAVING DOT PATTERNS

TECHNICAL FIELD

This invention relates to a card used in a card game or the like.

BACKGROUND ART

Conventionally, among game machines used by being connected with arcade game machines installed at game centers or the like or TV monitors or the like at home, there is known a card game device which is played by placing a card on the stage of the game machine.

As a card for use in playing such games, a card is suggested, on which back surface a pattern is printed with special ink which absorbs invisible light such as infrared rays (for example, Japanese Patent Publication no. 2002-301264). The pattern stores card data, such as data of an athlete, and the game proceeds by reading the pattern with an imaging unit placed below the stage.

DISCLOSURE OF THE INVENTION

Issues to be Solved by the Invention

However, as the pattern of the card cannot be changed with such a card, a user, once having obtained the card, can play a game only with certain data or a certain parameter. Thus, there is a problem that even after obtaining a card, it is difficult for a user to sustain interest in the card. Moreover, there is also a problem that lowered interest in the card diminishes user's interest in the game itself.

This invention was devised in view of such problems. Technical subject of this invention is to provide a flexible card which allows data of the card to be changed with a simple operation, thereby permitting users to sustain interest in the card and a relevant game.

Means to Solve the Issues

The present invention used the following means to solve the above-described problems.

According to the first aspect of the present invention, there is provided a card, that comprises a first dot pattern in which a coordinate value or a code value is patterned in a predetermined algorithm and which is recognizable by predetermined irradiation light on at least one surface of the card, and a second dot pattern patterned in a predetermined algorithm in a region overlapping with a region where the first dot pattern is provided.

According to the second aspect of the present invention, there is provided a card in accordance with the first aspect, wherein at least the first dot pattern is formed by being printed on a whole or a part of or the one surface of the card.

Therefore, a plurality of dot patterns are formed on a card, permitting parameters, such as the power of a character, to have more flexibility.

According to the third aspect of the present invention, there is provided a card in accordance with the first aspect, wherein the second dot pattern or a third dot pattern is formed on an element attachable to and detachable from the card.

Therefore, as changing of the dot pattern of a card becomes easy, in other words, parameters, such as the power of a character, can be easily changed, a flexible game with full of variety can be provided.

According to the forth aspect of the present invention, there is provided a card in accordance with the third aspect, wherein the element attachable to and detachable from the card is a sticker, and the second dot pattern or the third dot pattern is formed on at least a part of the sticker.

According to the fifth aspect of the present invention, there is provided a card in accordance with the forth aspect, wherein the sticker is attached in a foldable state along an edge of the card in both front and back surface directions of the card.

Therefore, a strip of the sticker can output two types of parameters, permitting the relevant game to have variation and flexibility.

According to the sixth aspect of the present invention, there is provided a card in accordance with the forth aspect, wherein the sticker is formed by laminating a plurality of strips of stickers, each of which has a dot pattern provided thereon.

Therefore, parameters such as the power of a character can be changed each time one of the laminated stickers is taken off. This sticker, thus, allows a user to have a thrill of expectation on what kind of power a character would have after taking off one of the laminated stickers, thereby permitting the user to have more interest in the relevant game.

According to the seventh aspect of the present invention, there is provided a card in accordance with the third aspect, wherein the element attachable to and detachable from the card stores the card and has a transparent body on which the second dot pattern or the third dot pattern is formed.

Therefore, changing of the transparent body can cause a change of a card parameter, permitting a user to have a variety of parameter with one card.

According to the eighth aspect of the present invention, there is provided a card in accordance with the seventh aspect, wherein different values are patterned as dot patterns between the sides of the transparent element facing the front and back surfaces of the card.

Therefore, a transparent body can provide two different parameters.

According to the ninth aspect of the present invention, there is provided a card in accordance with the third aspect, wherein the element attachable to and detachable from the card is a clip capable of holding a marginal portion of the card, and the second dot pattern or the third dot pattern is formed on at least a part of a surface of the clip.

Therefore, a card parameter can be changed merely by exchanging the clip.

According to the tenth aspect of the present invention, there is provided a card in accordance with the ninth aspect, wherein dot patterns of different values are formed on front and back surfaces of the clip.

Therefore, a clip can provide two different parameters.

According to the eleventh aspect of the present invention, there is provided a card in accordance with the ninth aspect, wherein the second dot pattern or the third dot pattern of the clip is formed on a sticker attached on a surface of the clip.

Therefore, changing a sticker being attached on the clip can cause the dot pattern of the clip to be changed, permitting more dot patterns to be provided.

According to the twelfth aspect of the present invention, there is provided a card in accordance with the eleventh aspect, wherein the sticker is formed by laminating a plurality of strips of stickers, each of which has a dot pattern provided thereon.

According to the thirteenth aspect of the present invention, there is provided a card in accordance with the twelfth aspect, wherein each layer of the laminated stickers has a dot pattern thereon such that an image of a dot pattern captured in a laminated state has a pattern meaning a value different from an image of a dot pattern captured in a state where at least one strip is peeled and removed from the laminated stickers.

According to the fourteenth aspect of the present invention, there is provided a card in accordance with the thirteenth aspect, wherein the sticker is formed with a material which reflects irradiating light for reading a dot pattern on the layer, and each sticker constituting each layer of the laminated stickers has a dot pattern of a different value with a material which absorbs the irradiating light.

Therefore, the imaging unit can read a dot pattern printed on the surface of the sticker without interference of other stickers in lower layers even when the stickers are laminated.

According to the fifteenth aspect of the present invention, there is provided a card in accordance with the fifth aspect, wherein a notch is provided on an edge of the card for positioning of the sticker upon attachment of the sticker.

Therefore, the sticker is prevented from being placed in an irregular position, permitting the sticker to be attached in an appropriate position.

According to the sixteenth aspect of the present invention, there is provided a card, that comprises a first dot pattern in which a coordinate value or a code value is patterned in a predetermined algorithm and which is recognizable by predetermined irradiation light on at least one surface of the card, and a second dot pattern patterned in a predetermined algorithm in a region overlapping with or a region different from a region where the first dot pattern is provided, wherein the second dot pattern or a third dot pattern is formed on a sticker attachable to and detachable from the card, the sticker is attached in a foldable state along an edge of the card in both front and back surface directions of the card, an adhesive layer is formed on one surface of the sticker, the adhesive layer is divided into a strong adhesive region and a weak adhesive region with a folding line as a border, the sticker is interposed by a peel-off liner on each adhesive region in a folded state before attached on the card, wherein upon peeling off the sticker from the peel-off liner, peeling off of one surface of the peel-off liner completes in a state where the peel-off liner remains attached only on the strong adhesive region of the sticker, the weak adhesive region of the sticker exposed in this one surface peeled-off state is attached on the front or back surface of the card, after peeling off the peel-off liner from the strong adhesive region, the sticker is folded along the edge of the card and the strong adhesive region is attached on the back or front surface of the card.

Therefore, since both surfaces of the peel-off liner are used, smaller area is required for the peel-off liner, which saves the space for vending machines for provision of the stickers. Further, making adhesion different for each adhesive region of the sticker allows a user to attach the sticker sequentially from one surface to the other, which prevents the sticker from being placed irregularly and facilitates the sticker to be attached in an appropriate position, thereby enhancing user friendliness.

According to the seventeenth aspect of the present invention, there is provided a card, that comprises a first dot pattern in which a coordinate value or a code value is patterned in a predetermined algorithm and which is recognizable by predetermined irradiation light on at least one surface of the card, and a second dot pattern patterned in a predetermined algorithm in a region overlapping or a region different from a region where the first dot pattern is provided, wherein the second dot pattern or a third dot pattern is formed on a sticker attachable to and detachable from the card, the sticker is attached in a foldable state along an edge of the card in both front and back surface directions of the card, an adhesive layer is formed on one surface of the sticker, the adhesive layer is divided into equal adhesive regions with a folding line as a border, the sticker is interposed by a peel-off liner on each adhesive region in a folded state, front and back surfaces of the peel-off liner are different in peel force, wherein upon peeling the sticker from the peel-off liner, peeling off of one surface of the peel-off liner completes in a state where only a weak peel force (strong adhesive) surface of the peel-off liner remains attached on the sticker, the adhesive region of the sticker exposed in this one surface peeled-off state is attached on the front or back surface of the card, after peeling off the remained weak peel force surface of the peel-off liner from the sticker, the sticker is folded along the edge of the card and the exposed adhesive region is attached on the back or front surface of the card.

Therefore, as the peel-off liner will not be torn in the midst of peeling of the peel-off liner, a sticker with a peel-off liner which provides significantly easier peeling-off experience can be provided.

According to the eighteenth aspect of the present invention, there is provided a card, that comprises a first dot pattern in which a coordinate value or a code value is patterned in a predetermined algorithm and which is recognizable by predetermined irradiation light on at least one surface of the card, and a second dot pattern patterned in a predetermined algorithm in a region overlapping or a region different from a region where the first dot pattern is provided, wherein the second dot pattern or a third dot pattern is formed on a sticker attachable to and detachable from the card, the sticker is formed by laminating a plurality of strips of stickers, each of which has a dot pattern provided thereon, wherein each layer of the laminated stickers has a dot pattern thereon such that an image of a dot pattern captured in a laminated state has a pattern meaning a value different from an image of a dot pattern captured in a state where at least one strip of the laminated stickers is peeled and removed, wherein the sticker is formed with a material which transmits irradiating light for reading a dot pattern, and dots are disposed on each layer of the laminated stickers so that a dot pattern obtained from a captured image of the irradiating light transmitted through each layer of the laminated stickers when the dot pattern id imaged in a laminated state where at least two strips of stickers are laminated means a value different from a dot pattern obtained from a captured image of the irradiation light transmitted through each layer of the laminated stickers when at least one strip of the laminated stickers is peeled and removed.

Moreover, according to the nineteenth aspect of the present invention, there is provided a card, that comprises a first dot pattern in which a coordinate value or a code value is patterned in a predetermined algorithm and which is recognizable by predetermined irradiation light on at least one surface of the card, and a second dot pattern patterned in a predetermined algorithm in a region overlapping or a region different from a region where the first dot pattern is provided, wherein the second dot pattern or a third dot pattern is formed on a sticker attached on at least a part of a clip which can retain a marginal portion of the card, the sticker is formed by laminating a plurality of strips of stickers, each of which has a dot pattern provided thereon, wherein each layer of the laminated stickers has a dot pattern thereon such that an image of a dot pattern captured in a laminated state has a pattern meaning a value different from an image of a dot pattern captured in a state where at least one strip of the laminated stickers is peeled and removed, wherein the sticker is formed with a material which transmits irradiating light for reading a dot pattern, and dots are disposed on each layer of the laminated stickers so that a dot pattern obtained from a captured image of the irradiating light transmitted through each layer of the laminated stickers when the dot pattern is imaged in a laminated state where at least two strips of stickers are laminated means a value different from a dot pattern obtained from a captured image of the irradiation light transmitted through each layer of the laminated stickers when at least one strip of the laminated stickers is peeled and removed.

Therefore, this sticker allows a user to have a thrill of expectation on what kind of power a character would have after taking off one of the laminated stickers, thereby permitting the user to have more interest in the relevant game.

According to the twelfth aspect of the present invention, there is provided a card in accordance with either the eighteenth aspect or the nineteenth aspect, which further comprises a mask portion (mask dots), on any one layer of the laminated stickers, made with a material which reflects irradiation light on the layer, so that dots disposed on lower layers are not imaged when irradiated with the irradiation light.

Therefore, dots disposed on lower layers can be easily hidden by the mask dots, facilitating values of the dot patterns to be different.

According to the twelve-first aspect of the present invention, there is provided a card in accordance with any one of the first to twelfth aspects, wherein dots constituting the dot pattern are formed with a material which absorbs the irradiating light.

Advantages of This Invention

According to this invention, as a plurality of dot patterns are formed on one card, the power or other parameters of the character of a card may have more variety. Furthermore, configuring a part of a dot pattern on a separate body allows the dot pattern to be changed easily, making one card possible to have a plurality of patterns of power and other parameters for a character to provide a flexible game with full of variety.

BRIEF DESCRIPTION OF THE DRAWINGS

FIGS. 6A to 6C are examples of information dot and bit expression of data defined therein, where FIG. 6A shows a two-dot arrangement; FIG. 6B shows a four-dot arrangement; and FIG. 6C shows a five-dot arrangement.

FIGS. 7A to 7D show modification examples of a dot pattern, where FIG. 7A is a schematic diagram of a six-information dot arrangement; FIG. 7B is a schematic diagram of a nine-information dot arrangement; FIG. 7C is a schematic diagram of a 12-information dot arrangement; and FIG. 7D is a schematic diagram of a 36-information dot arrangement.

FIGS. 18A to 18C are diagrams illustrating a plurality of strips of stickers characterized by being laminated.

FIGS. 23A1 to 23C3 are diagrams illustrating a sticker where a dot pattern may change by being attached another sticker over the dot pattern of the sticker.

DESCRIPTION OF REFERENCE NUMERALS AND SIGNS

1 Dot Pattern
2 Key Dot
3 Information Dot
4 Reference Grid Point Dot
5 Virtual Grid Point

PREFERRED EMBODIMENTS OF THE INVENTION

Figure 1:
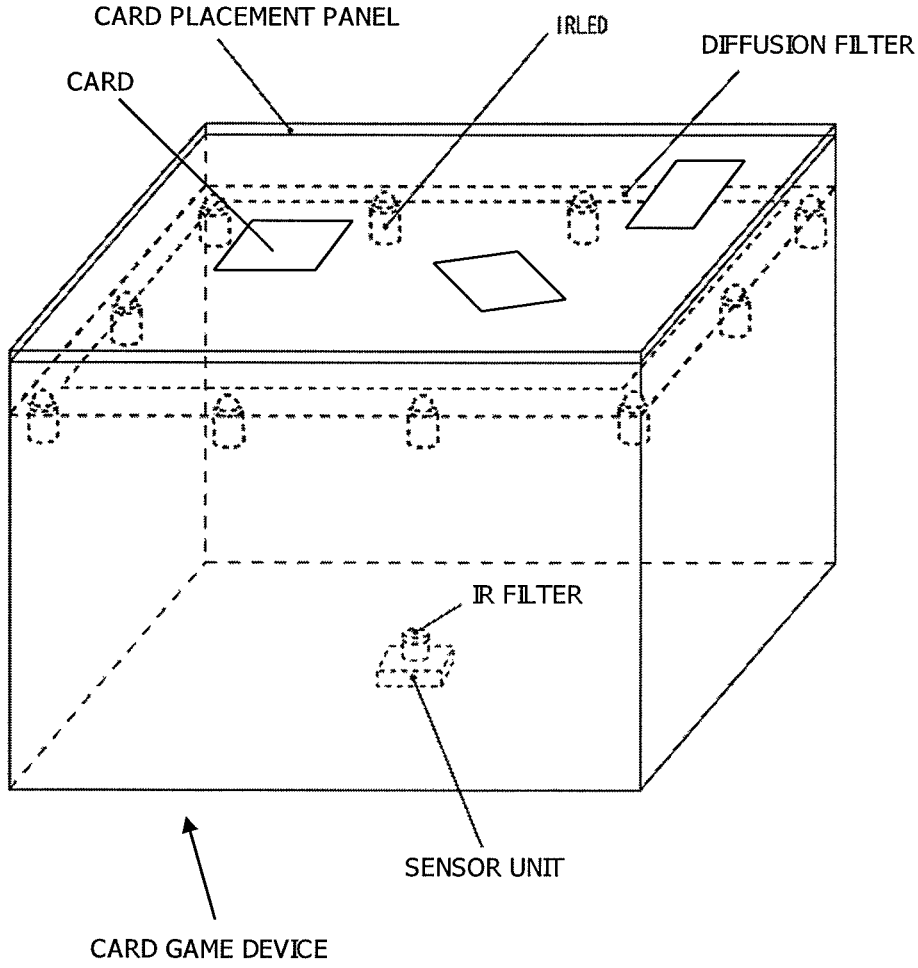
FIG. 1 is a diagram showing a card game device which uses a card of the present invention.

FIG. 1 is a diagram for illustrating a use state of the card of the present invention and a card game device.

As shown in FIG. 1, the card is used when playing a game with a card game device. In such a card game device, one sensor unit (an imaging unit) captures the entire lower surface of the card placement panel. In the space below the lower panel surface, an IRLED which irradiates with irradiation light a dot pattern on the surface of a card placed on the upper panel surface and a diffusion filter which diffuses this irradiation light over the lower panel surface are provided at positions where light from the panel surface to be imaged by the sensor unit can be avoided.

The diffusion filter is provided in a frame board shape, which protrudes from a side wall portion constituting the device chassis to the space below the card placement panel. This diffusion filter is configured with a transparent or translucent glass board or synthesis plastic board, and satin finishing is processed on one surface thereof. IRLED irradiation light can irradiate the entire lower surface of the card placement panel by being diffused through this diffusion filter. When a card is placed on the card placement panel, the irradiation light irradiates the surface of this card and the reflected light thereof is imaged by the sensor unit.

Although not shown in the drawings, the sensor unit is connected, through a cable, to a Micro Processing Unit (MPU) having a frame buffer. This Micro Processing Unit (MPU) is connected to a central processing unit of a game machine which is further connected to a display and a speaker. When the sensor unit and the Micro Processing Unit (MPU) read out a dot pattern printed on a card, the dot pattern is converted to a cord value and an image or a motion picture corresponding to the code value is displayed on the display device.

Next, a dot pattern used for the card of this embodiment is described.

The dot pattern used for the card of this embodiment is the dot pattern shown in FIGS. 8A-11. However, the basic principle as a prerequisite knowledge of the dot pattern is first described below with reference to FIGS. 2-7D.

Figure 2:
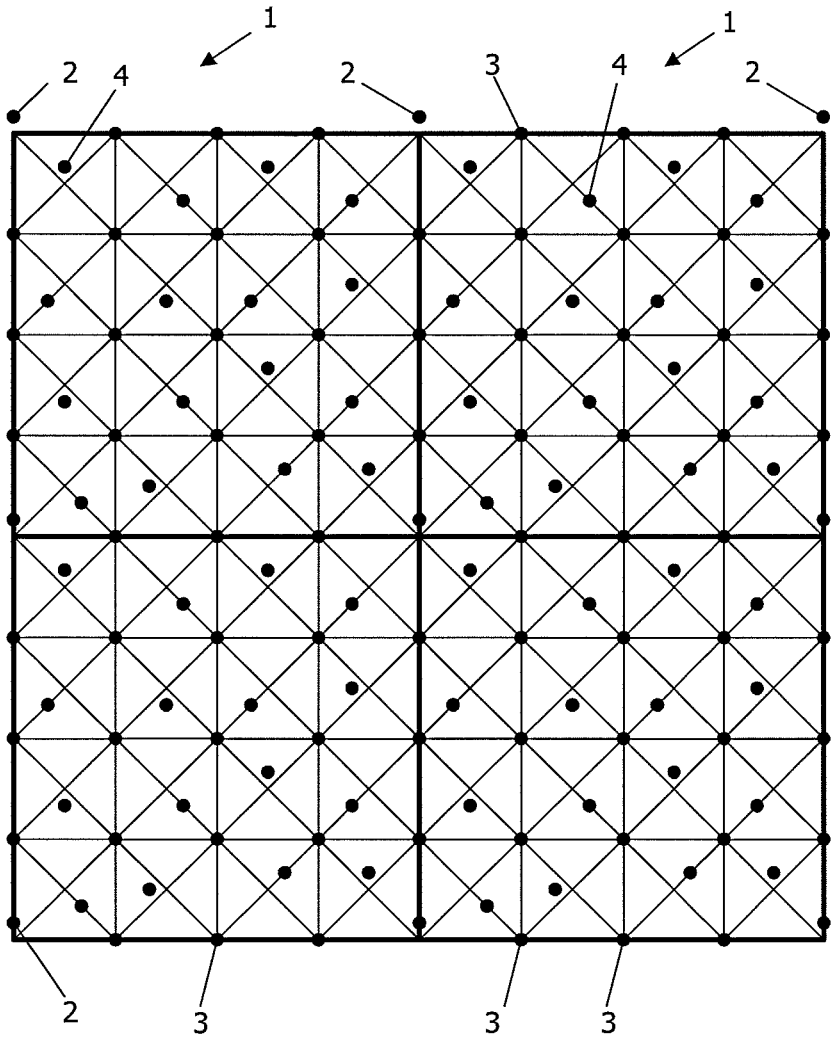
FIG. 2 is an explanatory view showing an example of a dot pattern.

FIG. 2 is an explanatory view showing an example of the dot pattern of this invention, called GRID1.

Horizontal and vertical grid lines in these figures are added for a convenience of explanation, thus do not exist in real printed surfaces. If the scanner as an imaging unit has an infrared irradiation unit, the constituents of the dot pattern 1, including key dots 2, reference grid point dots 3, and information dots 4, are preferably printed with carbon ink or stealth ink (invisible ink) which absorbs the infrared rays.

Figure 3A:
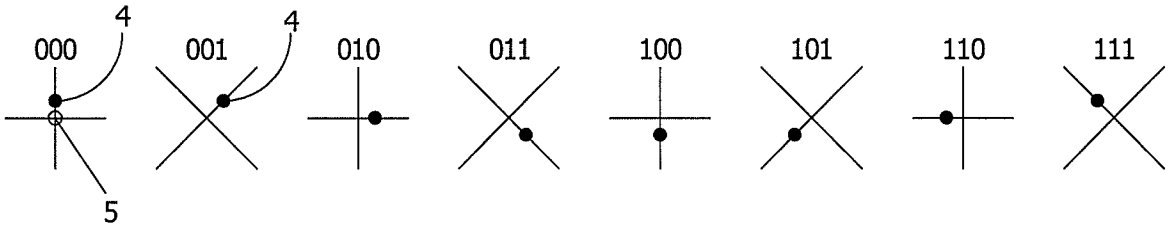
FIG. 3 is an enlarged view showing an example of information dot of a dot pattern.
Figure 3B:
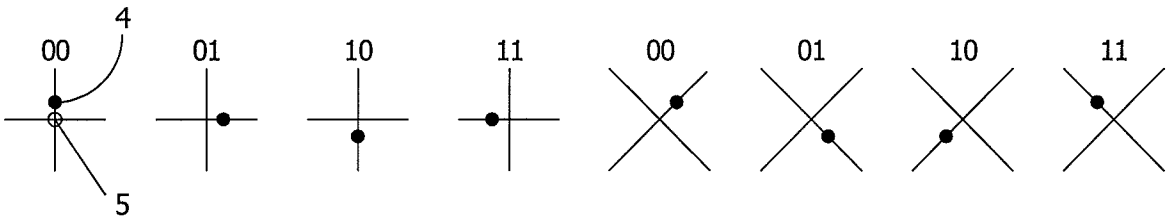

FIG. 2 is an enlarged view showing an example of arrangement of key dots 2, reference grid point dots 3, and information dots 4 of dot patterns 1. FIGS. 3A and 3B are explanatory views showing information dots 4 expressing vector information and codes thereof.

The information input/output method using the dot pattern comprises steps of generating a dot pattern 1, recognizing the dot pattern 1, analyzing the dot pattern 1, and outputting information and a program from this dot pattern 1. That is, the method retrieves dot patterns 1 as an image data with a sensor unit, extracts reference grid point dots 3, then extracts key dots 2 based on the fact that dots are located at positions shifted in a predetermined direction instead of located at positions where reference grid point dots 3 are supposed to be, then identifies one block of dot pattern 1 and its direction. Next, the method extracts information dot 4, each surrounded by four reference grid point dots 3 or key dots 2, encodes the information dots 4 with a predetermined algorithm, decodes to a predetermined code value and/or a coordinate value from an aggregate of each information dot 4 based on the arrangement of information dots 4 in one block of dot pattern 1, and outputs information or a program corresponding to this code value and/or coordinate value from an information processing device, personal computer, PDA, mobile phone, or the like.

In producing a dot pattern 1, fine dots, including at least one key dot 2, information dot 3, and reference grid point dot 4, are arranged in accordance with a predetermined rule based on a dot cord generation algorithm, for causing recognition of vector information for encoding. As shown in FIG. 2, in a block of a dot pattern 1, there is arranged 5×5 reference grid point dots 3 and information dots 4, each of the information dots 4 is surrounded by four reference grid point dots 3 or disposed in the vicinity of a virtual central point 5 surrounded by reference grid points. The information dots 4 express vector information. Further, key dots 2 define arrangements and structures of blocks. For this embodiment, the dot of a key dot 2 is not disposed over a reference grid point at a corner of a block, instead, disposed by shifting a predetermined direction. The key dot 2 defines a size of a block as well as a direction of the block (i.e., a direction of a dot pattern 1). This block defines arbitrary numerical information. Further, the illustration of FIG. 2 shows a state where four blocks of dot pattern 1 (enclosed with bold lines) are arranged in parallel. However, dot pattern 1 is, of course, not limited to four blocks.

Key dot 2 may not be limited to be disposed at a corner of the block, yet may be disposed wherever in or outside a block.

When retrieving this dot pattern 1 as an image data with a sensor unit, a dot code analyzing algorithm can correct a distortion of reference grid point dots 3 attributable to a distortion of the lens of the sensor unit, a distortion caused by imaging from an angle, expansion and contraction of paper surface, curvature of medium surface, or a distortion upon printing. Specifically, a calibration function which converts distorted four reference grid point dots 3 to form the original square or rectangle shape, $(X_n, Y_n)=f(X_n', Y_n')$ is resolved, and the same function is used to calibrate information dots 4 to obtain vector information based on the correct positions of information dots 4.

An information dot 4 is a dot for causing recognition of a variety of vector information. This information dot 4 is disposed in a block of a dot pattern 1 configured by a key dot 2, and also disposed at the end point of a vector expressed with a virtual central point 5, surrounded by four reference grid point dots 3, as the starting point. For example, this information dot 4 is surrounded by four reference grid point dots 3 or reference grid points, and as shown in FIG. 3A, since the dot which has a distance from the virtual central point 5 has a direction and length when expressed as a vector, the dot is disposed in eight directions by being rotated by 45 degrees in a clockwise direction and encoded in 3 bits. Therefore, 3 bits×16 dots=48 bits can be expressed in a block of a dot pattern 1.

FIG. 3B is a method for encoding each information dot 4 in 2 bits in a dot pattern of FIG. 2. Dots are shifted in a + direction and an x direction and each dot is encoded in 2 bits, expressing 2 bits×16 dots=32 bits. In this way, in principle, 48 bit numerical information can be defined in a block of a dot pattern 1. However, bits can be divided according to use purposes and data can be given for each 32 bits. Maximum of $2^{16}$ (about 65,000) patterns of information dot arrangement patterns can be realized by combining a + direction and an x direction.

Moreover, not limited to this, dots may be disposed in a variety of directions and encoding may be changed, such as dots disposed in 16 directions and encoded in 4 bits.

Dot diameters of a key dot 2, a reference grid point dot 3 and an information dot 4, are preferably in a range of about 0.03-0.05 mm, in consideration of a viewing quality, paper property, printing accuracy, resolution of a sensor unit, and optimal digitalization.

Also, in consideration of necessary information amount for an imaging area and possible misrecognition with dots 2, 3, and 4, the gap between reference grid point dots 3 is preferably in a range of about 0.3-0.5 mm in both horizontal and vertical directions. In consideration of possible misrecognition with a reference grid point dot 3 and an information dot 4, displacement of a key dot 2 is preferably around 20% of the grid gap.

The gap between this information dot 4 and a virtual central point 5 surrounded by reference grid point dots 3 is preferably a gap about 15-30% of the distance between an adjacent reference grid point dot 3 and the virtual central point 5. If the distance between an information dot 4 and a virtual central point 5 is larger than this gap, the reference grid point dot 3 and the information dot 4 are likely to be seen as a lump, which degrades visual quality of a pattern of the dot pattern 1. On the other hand, if the distance between an information dot 4 and a virtual central point 5 is smaller than this gap, it is hard to recognize as to which direction a information dot 4, which has vector information with a virtual central point 5 at a center, is located.

Figure 4A:
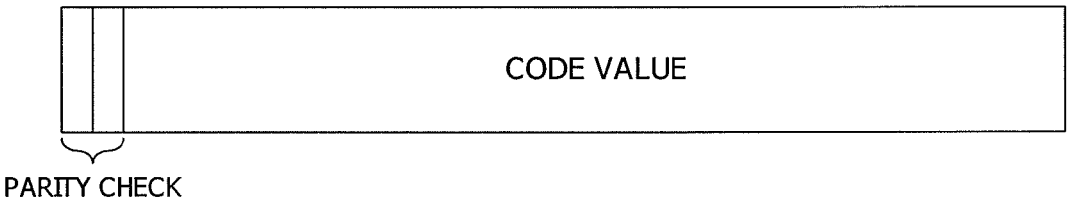
FIGS. 4A and 4B are explanatory views showing examples of dot pattern formats.
Figure 4B:
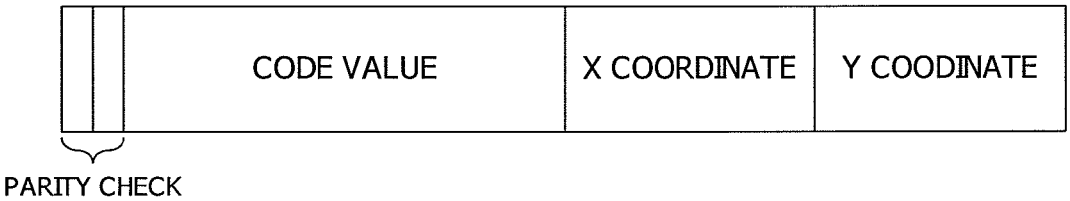

As shown in FIG. 2, one dot pattern 1 is a dot pattern 1 comprising 4×4 block regions. Each block has an information dot/information dots 4 of 2 bits. FIGS. 4A and 4B show dot code formats of a block of a dot pattern 1, an aggregate of information dots 4.

As shown in FIG. 4A, one dot pattern 1 stores a parity check and code value, while, in FIG. 4B, stores a parity check, code value, and XY coordinate value. A dot code format can be arbitrary defined.

Figure 5:
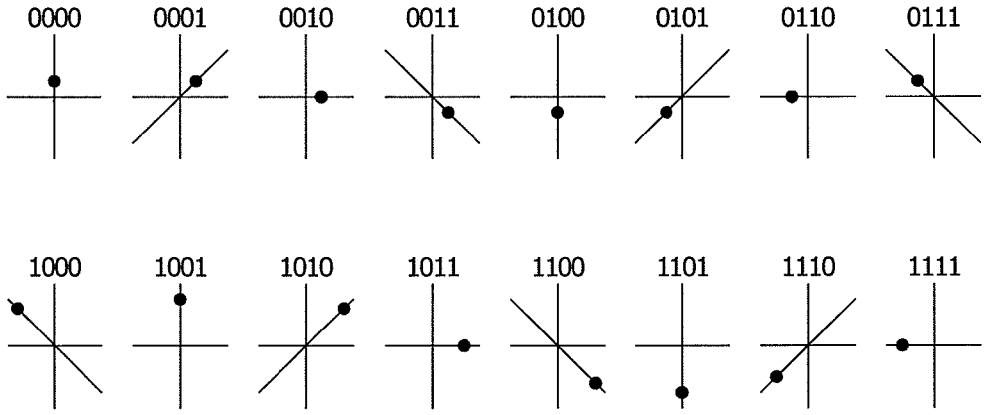
FIG. 5 is an example of information dot and bit expression of data defined therein, showing another embodiment.

FIG. 5 is an example illustrating another embodiment of information dots 4 having vector information and the encodings thereof. As in this example, if two types of information dots 4, long distance and short distance from a virtual central point 5 surrounded by reference grid point dots 3 or reference grid points are used, indicating eight vector directions, they can be encoded in 4 bits. Here, the long distance is preferably about 25-30% of the distance between adjacent virtual central points 5, and the short distance is preferably about 15-20% of the distance between adjacent virtual central points 5. However, the gap between the centers of long distance information dot 4 and short distance information dot 4 is preferably longer than the diameters of these information dots 4.

If there are a plurality of information dots 4 surrounded by four reference grid point dots 3 or reference grid points, adjacent dots are likely to be seen as a lump, and a visible pattern is generated. Thus, one information dot 4 is preferably disposed, in view of visual quality. However, greater amount of information may be included if one vector is encoded in 1 bit to express a plurality of information dots 4, if information amount is a requirement disregarding the visual quality. For example, eight direction concentric vectors can be encoded in 8 bits, as 0-8 of information dots 4, each surrounded by four reference grid point dots 3 or reference grid points, can be encoded. Sixteen vectors comprising double eight concentric vectors can be encoded in 16 bits, as 0-16 information dots 4 can be disposed in a block.

FIGS. 6A to 6C are examples of information dots 4 of 16 vectors comprising double eight concentric vectors. FIG. 6A shows an arrangement of two information dots 4; FIG. 6B shows an arrangement of four information dots 4; and FIG. 6C shows an arrangement of five information dots 4.

FIGS. 7A to 7D are modification examples of a dot pattern 1. FIG. 7A is a schematic view in which six square or rectangular regions, each constructed by four reference grid point dots 3 or reference grid points which surround an information dot 4, are disposed. FIG. 7B is a schematic view in which nine of the regions are disposed. 7C is a schematic view in which 12 of the regions are disposed. 7D is a schematic view in which 36 of the regions are disposed.

The dot pattern 1 shown in FIG. 2 shows an example in which 16 (4×4) information dots 4 are arranged in a block. However, information dots 4 are not limited to arrangement of 16 dots in a block. As shown in FIGS. 6A to 7D, a region, constructed by four reference grid point dots 103 or reference grid points which surround an information dot 104, and encoding of the information dot 104 defined by the region may be changed in a variety of ways.

Figure 8A:
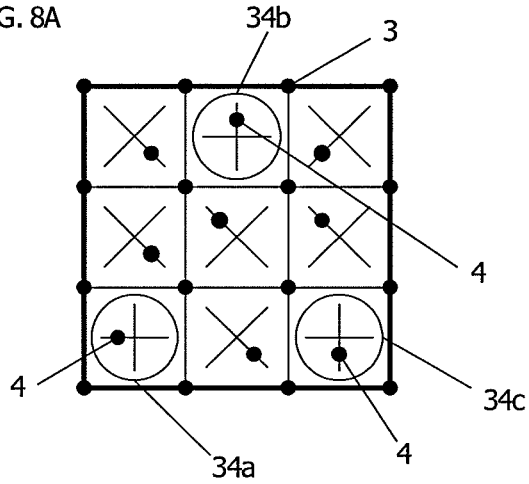
FIGS. 8A and 8B are explanatory views defining the direction of a block by changing the way of information dot arrangement in the dot patterns shown in FIGS. 2 to 7.
Figure 8B:
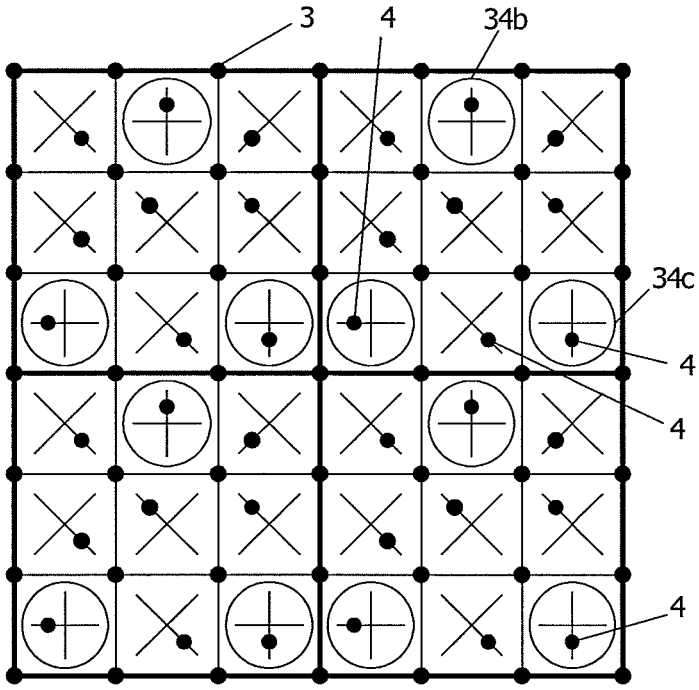

Next, a dot pattern used in the card of this embodiment is described. FIGS. 8A and 8B show a definition of a direction of a block, in dot patterns described in FIGS. 2 to 7D. The direction of a block is defined by changing the direction arrangement of an information dot 3 only for a specific grid region (a direction region) from other grid regions (direction regions) in a dot pattern of a block constituted by 3×3=9 grid regions.

That is, in FIG. 8A, information dots 4 are disposed in horizontal and vertical directions from the centers in the grid region 34*a* at lower left, in the grid region 34*b* in the middle, and in the grid region 34*c* at lower right, and disposed in a diagonal direction from the centers in other grid regions. As such, by disposing the grid regions 34*a*, 34*b*, and 34*c*, the block is recognized as facing upwards from the shape of the triangle shaped by connecting these grid regions, that is, a relationship of vertex 34*b* with reference to a base 34*a*, 34*c*.

In this way, a direction of a block can be defined by an arrangement relationship (here, a triangle) of the grid regions 34*a*, 34*b*, and 34*c* where arrangement directions of information dots 4 in a block are changed (by arranging information dots in horizontal and vertical directions from the centers). As such, since information dots 4 can be disposed in all grid regions of a block, information dots 4 can be disposed in all grid regions without sacrificing grid regions for key dots.

FIG. 8B shows a dot pattern in which two of the block in FIG. 8A are concatenated in vertical and horizontal directions respectively.

Figure 9A:
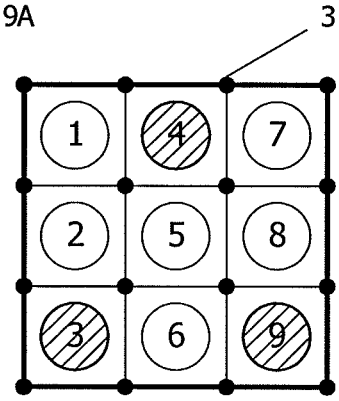
FIGS. 9A and 9B are explanatory views defining the direction of a block by changing the way arranging information dot in dot patterns shown in FIGS. 2 to 7, showing an arrangement of information dot.
Figure 9B:
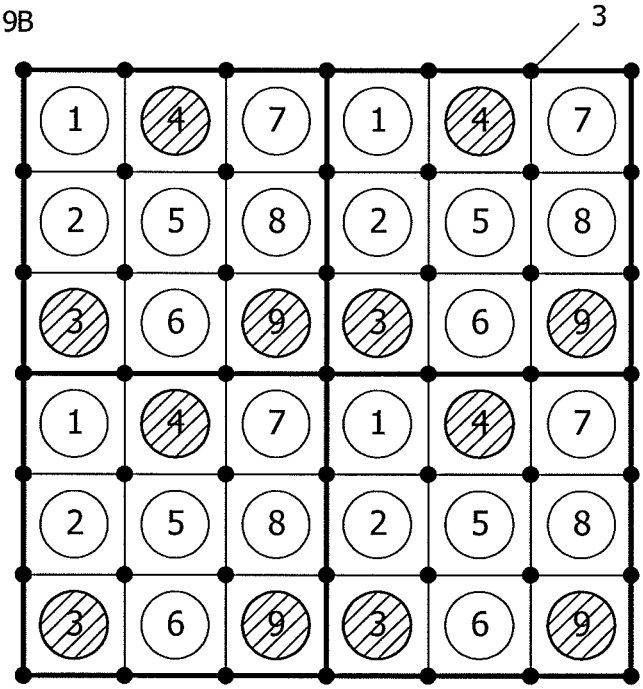

FIG. 9A and FIG. 9B are diagrams showing arrangement state of the information dots 3 corresponding to FIGS. 8A and 8B respectively.

Figure 10:
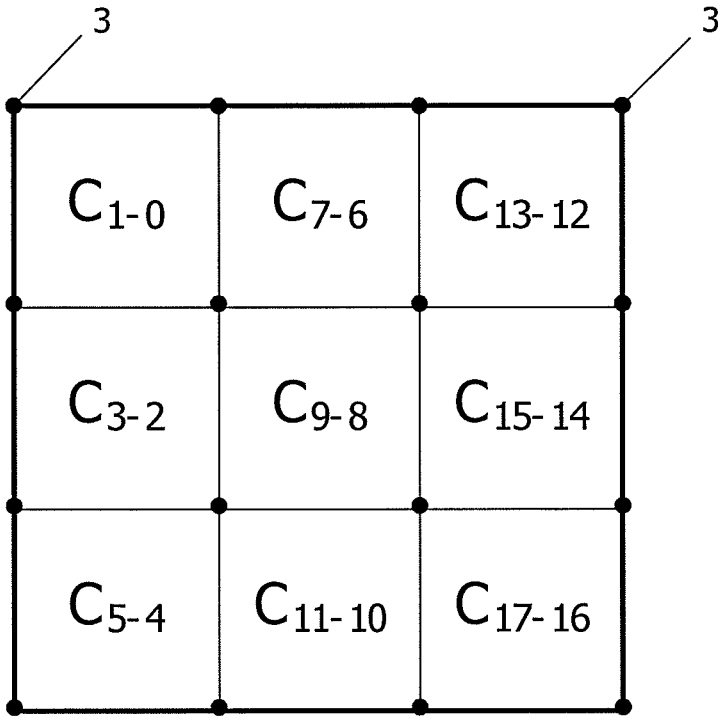
FIG. 10 is an explanatory view showing dot arrangement of dot patterns shown in FIGS. 8 and 9.
Figure 11:
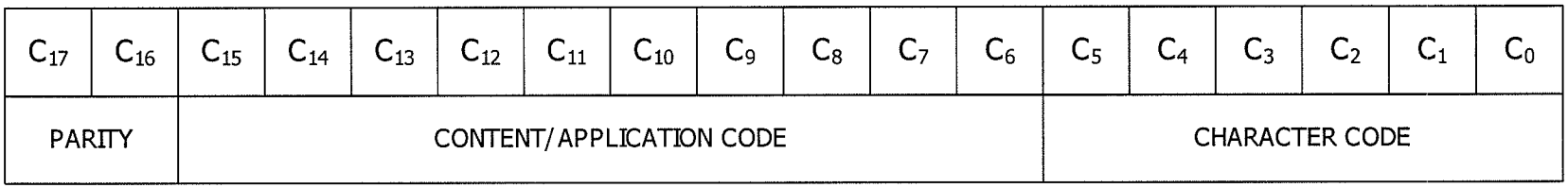
FIG. 11 is a diagram illustrating a dot pattern format of dot patterns shown in FIGS. 8 and 9.

FIG. 10 and FIG. 11 are explanatory views showing a relationship among a dot pattern, code value, and an identifier.

As shown in FIG. 10, the dot pattern is a dot pattern comprising 3×3 block regions. The block is divided into $C_{1-0}$ to $C_{17-16}$. FIG. 11 shows a dot code format of each region.

As shown in FIG. 11, $C_0$-$C_5$ means a character code; $C_6$-$C_{15}$ means a content/application code; and $C_{16}$-$C_{17}$ means a parity code.

Also, when printing a dot pattern on the back surface of a card, the distance between grids is preferably approximately 15 mm, and the size of a dot is preferably approximately 15% of the distance between dots. Thus, the size of the dot is preferably 2 mm to 2.5 mm, but not limited to this. The resolution of the distance between dots upon capturing the image is preferably 14 pixels or more.

Figure 12A:
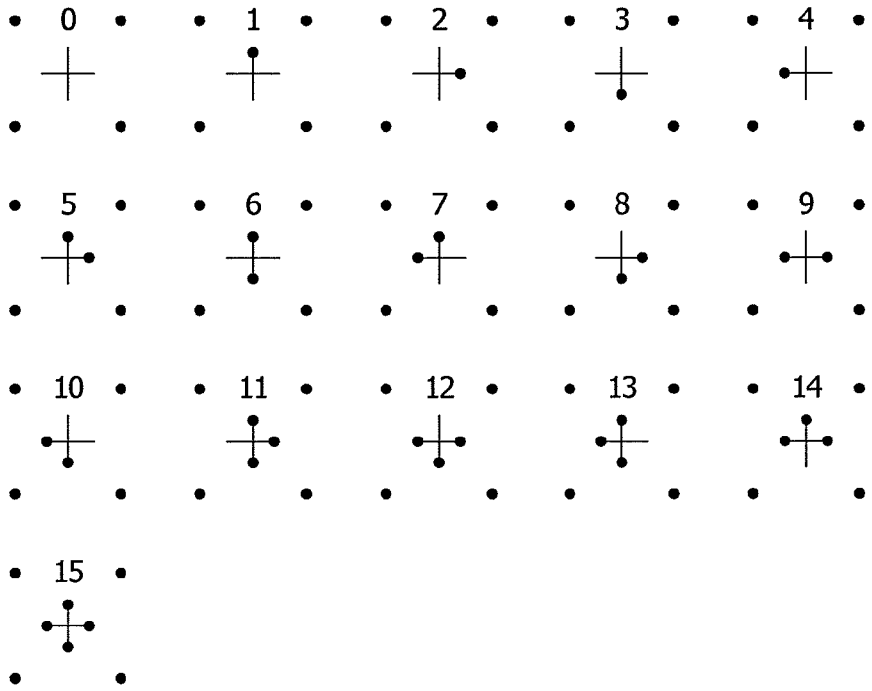
FIGS. 12A and 12B are diagrams illustrating other examples of dot arrangement.
Figure 12B:
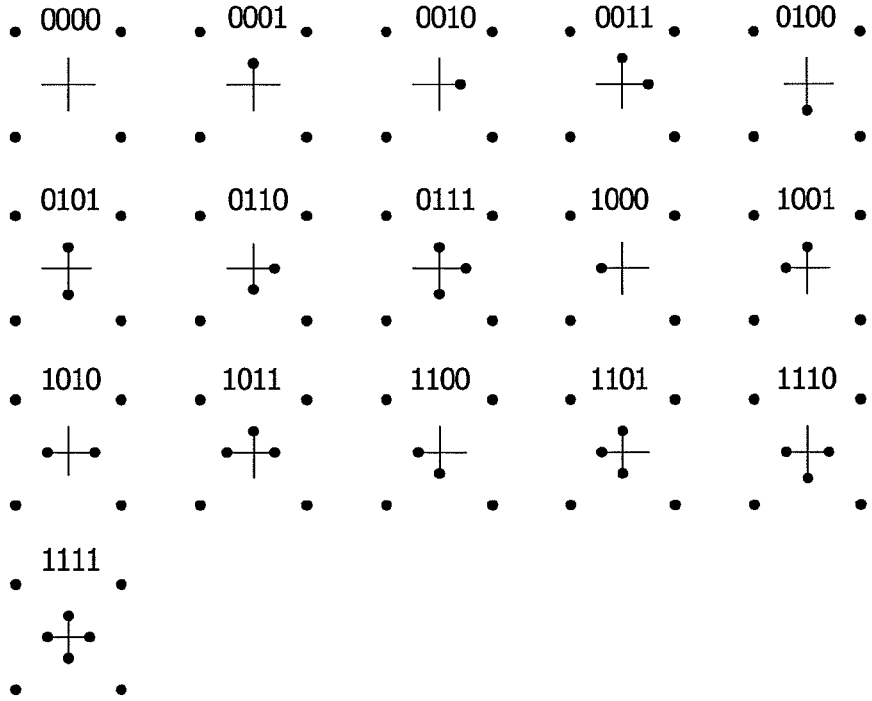

This invention also uses a dot pattern for a sticker described below. FIGS. 12A and 12B illustrate a dot pattern used for this sticker.

In FIG. 12A, values of 0 to 15 are expressed depending on the number of information dots and the arrangement thereof. Zero means no information dot. One information dot means one of 1-4 depending on the arrangement. Two information dots means 5-10. Three information dots means 11-14. Four information dots means 15.

FIG. 12B expresses four bit values ranging from 0000 to 1111. Positive y direction with reference to a virtual central point 5 means first digit; positive x direction means seconds digit; negative y direction means fourths digit; and negative x direction means eighths digit. For each digit, 1 refers to when information dot is disposed; 0 refers to when no information dot is disposed. For example, if information dot is not disposed anywhere, the value is 0000. If dots are disposed in positive y and positive x directions only, first digit and seconds digit are 1, and fourths digit and eighths digit are 0, thereby constituting 0011.

Figure 13A:
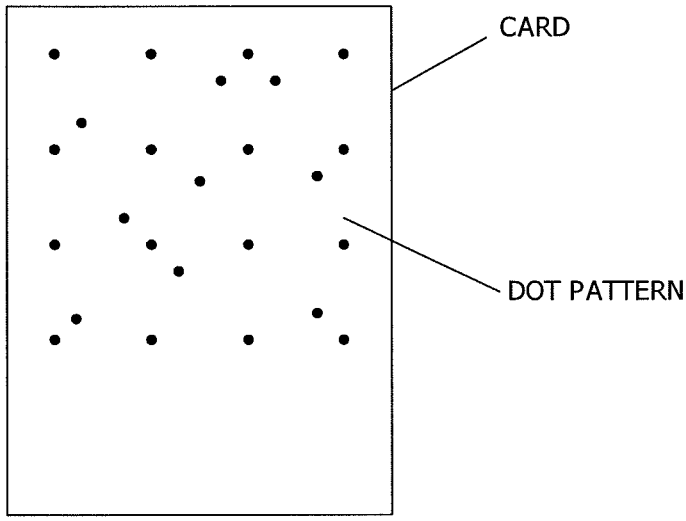
FIGS. 13A to 13C are diagrams illustrating a card and a sticker of the present invention.
Figure 13B:
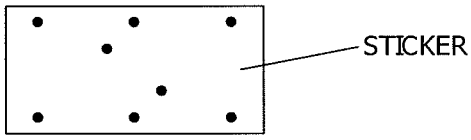
Figure 13C:
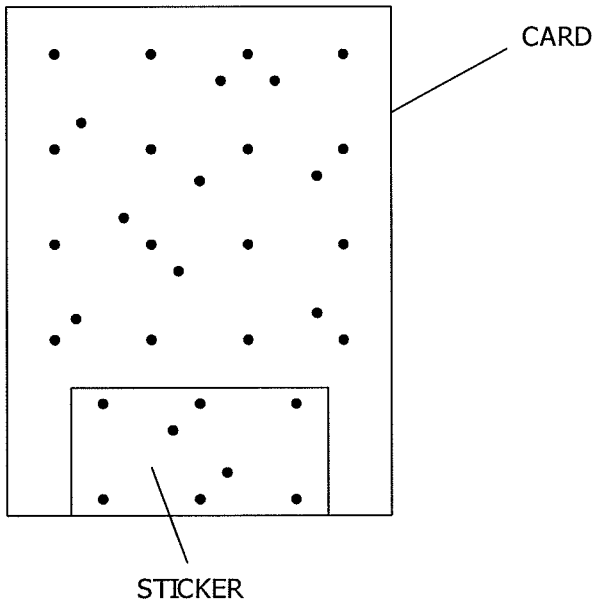

FIGS. 13A to 13C are diagrams illustrating a card used in this embodiment and another element to be attached on the card.

The card in the present invention is characterized by being provided with a first dot pattern in which a coordinate value or a code value is patterned in the above-mentioned algorithm and which is recognizable with a predetermined irradiation light on at least one surface thereof. The card is also provided with a second dot pattern patterned in a predetermined algorithm in a region overlapping with a region where the first dot pattern is provided or a region different from a region where the first dot pattern is provided. Both the first and second dot patterns may be printed on a card, or, as described below, the first dot pattern may be printed on a card and the second dot pattern may be formed on another detachable element. Alternatively, the first dot pattern and second dot pattern are printed on a card, and a third dot pattern may be formed on another detachable element.

Further, dots which constitute such dot patterns are preferably provided with a material which absorbs irradiation light such as infrared rays.

As shown in FIG. 13A, the above-described dot pattern is printed on the back surface (or the front surface) of a card. A code value meaning a character is registered in this dot pattern. FIG. 13B shows the other element used in this embodiment. This other element is formed as a sticker, on which surface a dot pattern is printed. A code value meaning the power in a game as a parameter is registered. For example, the type and strength of a technique, such as a strong standing technique or strong groundwork technique, are registered as numerical code values. FIG. 13C is a diagram illustrating the method to use a card and a sticker. As shown in FIG. 13C, a sticker shown in FIG. 13B is used by attaching on the lower portion of the card. The sensor unit in the card game device reads out both the dot pattern on the card and the dot pattern on the sticker. In this way, a character and power corresponding to the dot pattern are output and the game proceeds.

Figure 14:
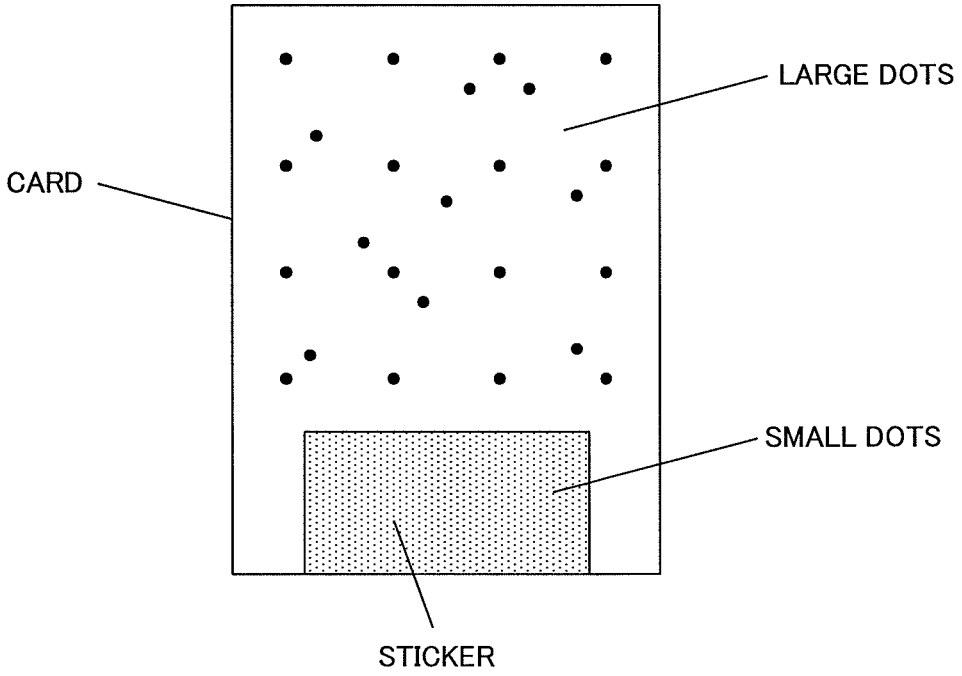
FIG. 14 is a diagram illustrating an embodiment in which dot sizes are different between a card and a sticker.

Sizes of dots used for a card and a sticker may be different in this invention. For example, as shown in FIG. 14, dots used for a card may be large dots and dots used for a sticker may be small dots. The other way around is, of course, possible.

FIGS. 15 to 17C are diagrams for illustrating a sticker to be attached on the lower portion of a card.

Figure 15:
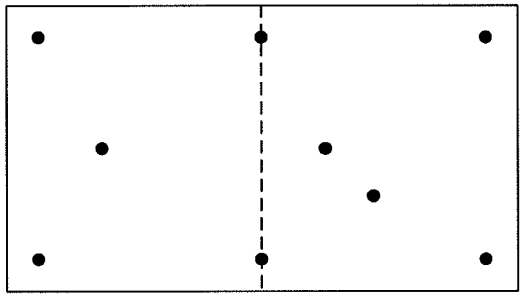
FIG. 15 is a diagram illustrating a sticker of the present invention.

FIG. 15 is a sticker formed in a plain shape. That is, adhesive agent is applied on the back surface (or the front surface) of the backing material on which a dot pattern is printed. Silicon oil is applied over the surface and a detachable liner is attached. Material with relatively low adhesion and readhesion properties is used as the adhesive agent. As such, the sticker can be repeatedly attached on and detached from the card.

Figure 16A:
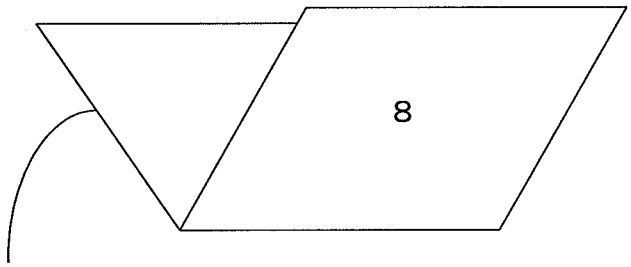
FIGS. 16A and 16B are diagrams illustrating a sticker characterized by being used in a folded state.
Figure 16B:
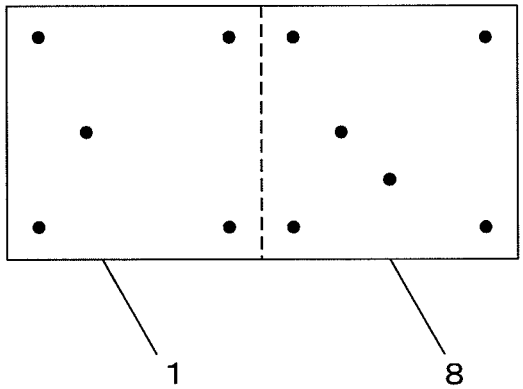

FIGS. 16A and 16B are a sticker characterized by being used in a folded state. The sticker is attached along the edge of the card in a foldable state on both front and back surfaces of the card. FIG. 16A shows a folded state, while FIG. 16B shows a specific example of a dot pattern printed on a sticker. A liner is attached on the back surface of the sticker, and lengthwise cut is provided in the middle of the liner. As such, the liner is configured as being easily attachable to one side at each time. In this embodiment, as shown in FIG. 16B, a dot pattern meaning 8 and a dot pattern meaning 1 are printed. The power of a character is different between when the sticker is attached so that the dot pattern meaning 8 is placed on the back surface of a card (a dot pattern printed surface) and when the sticker is attached so that a dot pattern meaning 1 is placed on the back surface of a card.

In this way, two types of parameters are able to be output from a strip of sticker, thereby making the game flexible.

Figure 17A:
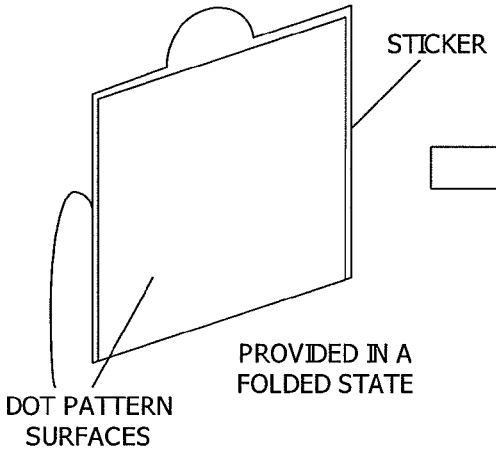
FIGS. 17A to 17C are diagrams illustrating a sticker characterized by being used in a folded state and provided in a closed state.
Figure 17B:
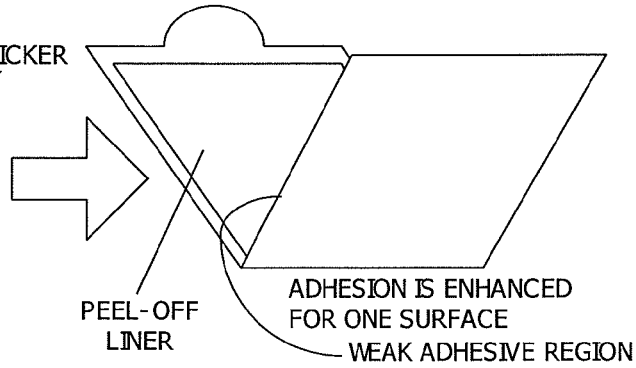
Figure 17C:
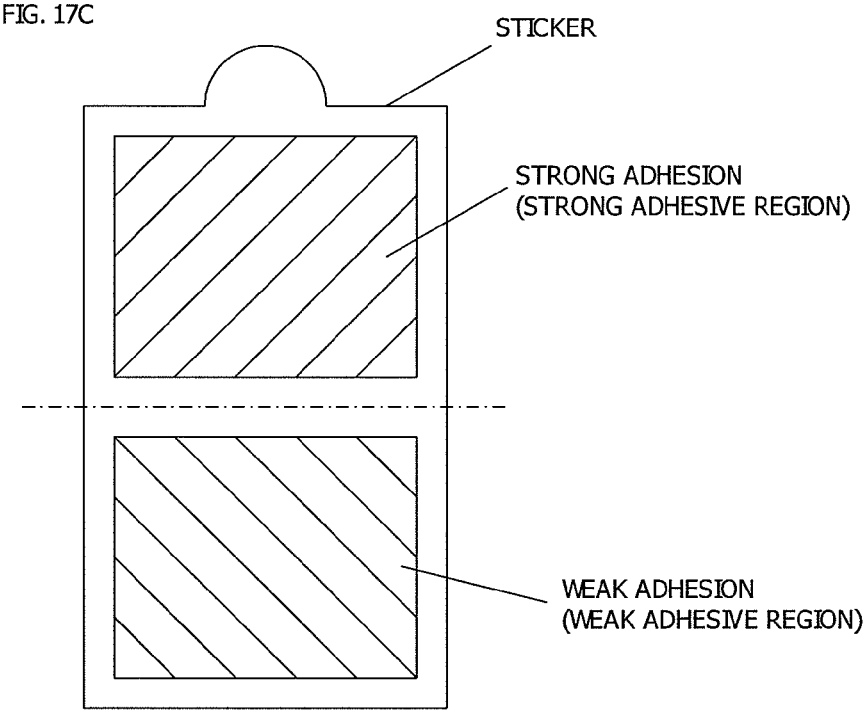

FIGS. 17A to 17C show a modification example of a sticker used in a folded state. This sticker is, as shown in FIG. 17A, configured in a folded state upon provision.

As shown in FIG. 17C, an adhesive layer is formed on a surface of the sticker. The adhesive layer is divided into a strong adhesive region and a weak adhesive region with the folding line as a border. One strip of peel-off liner for each adhesive region is interposed in a folded state before attachment. As shown in FIG. 17B, upon peeling a sticker from a peel-off liner, peeling-off of one surface completes in a state in which the peel-off liner remains attached only on the strong adhesive region of the sticker. The weak adhesive region exposed in this one-surface peeled-off state is attached on the front or back surface of the card. Then, after the peel-off liner on the strong adhesive region is peeled off, the sticker is folded along the edge of the card, and the strong adhesive region is attached on the back or front surface of the card.

As such, with a sticker configured in a folded state, the sticker may be provided with a smaller surface area. Thus, vending machines and the like may consume less space. Also, with different adhesion in each adhesive region of the sticker, a user can surely peel off the sticker sequentially from one to the other surface of the card.

Also, as described below, it is possible to provide a sticker in a folded configuration by differentiating peel force of front and back surfaces of the peel-off liner.

An adhesive layer is formed on one surface of a sticker, which has an identical adhesion between regions divided by a folding line as a border. One peel-off liner is interposed for each adhesive region of the sticker in a folded state before attachment on a card. The peel force of the peel-off liner is different between the front and back surfaces. When the sticker is peeled off from the peel-off liner, peeling off of one surface of the peel-off liner completes in a state where only the surface of the peel-off liner with weak peel force (strong adhesion) remains attached. The adhesive region exposed in this one surface peeled-off state is attached on the front or back surface of a card. Then, after peeling off the peel-off liner from the weak peel-off force surface of the sticker on which the peel-off liner had remained attached, the sticker is folded along the edge of the card to attach the exposed adhesive region on the back or front surface of the card.

Production processes upon producing a sticker which is provided with a strong adhesive region and a weak adhesive region, as shown in FIGS. 17A to 17C, are complicated. Therefore, making a sticker with identical adhesion all over and differentiating peel force of a peel-off liner between the front and back surfaces of the peel-off liner allows a provision of a user-friendly sticker in attachment and peeling off thereof produced through easy production processes.

Figure 19:
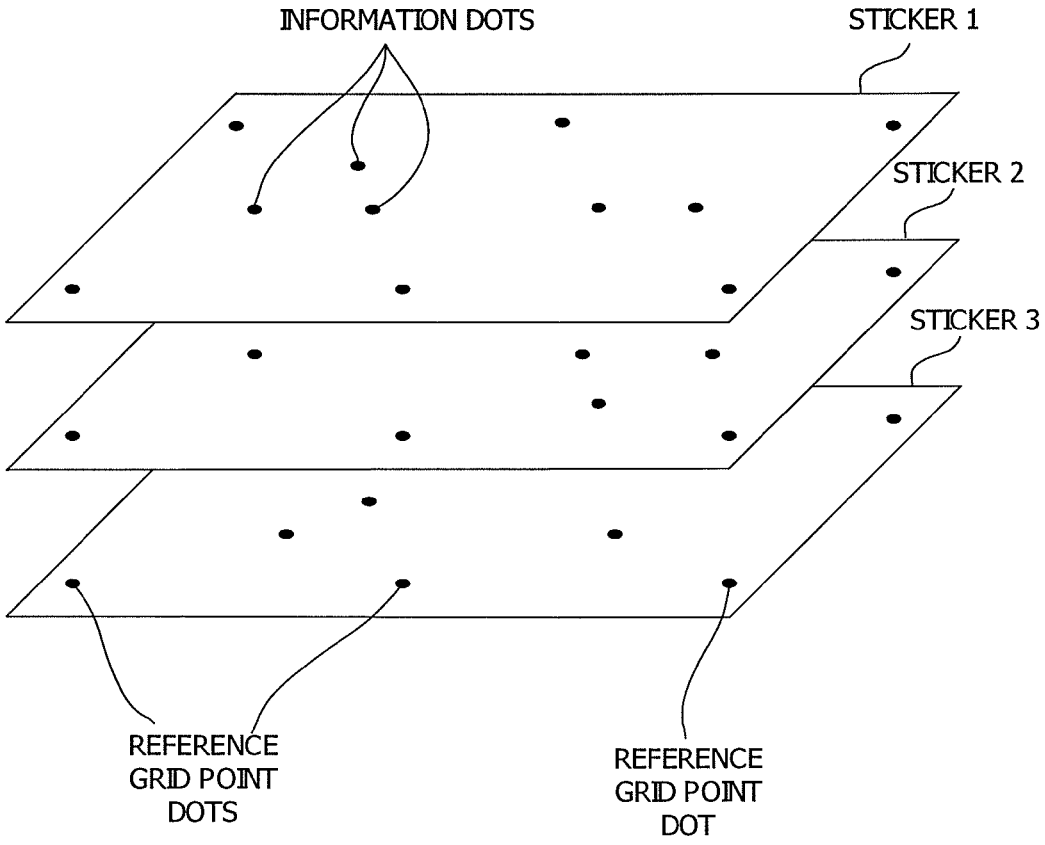
FIG. 19 is a perspective view showing how the stickers shown in FIGS. 18A to 18C are laminated.

FIGS. 18A to FIG. 19 are diagrams for illustrating another embodiment of the sticker.

This embodiment is configured by laminating a plurality of strips of stickers each provided with a dot pattern. A dot pattern is formed on each layer of the sticker so that a dot pattern image captured in a laminated state has a different meaning from a dot pattern image captured in a state where at least one strip of the laminated stickers is peeled and removed. The sticker is configured with a material which reflects irradiation light for reading a dot pattern on the layer. The sticker constituting each layer is provided with a dot pattern each of which has a different meaning, and the dot pattern is made with a material which absorbs the irradiation light. As such, dot patterns printed on a sticker of the second layer and below cannot be recognized until the laminated sticker is peeled off. Therefore, an independent dot pattern is printed on each sticker and information dots printed on one sticker do not affect dot patterns of the other stickers. FIG. 18A is a diagram showing a state before taking off the stickers. FIG. 18B is a diagram showing a state after taking off one strip of the stickers. FIG. 18C is a diagram showing a state after taking off another strip of stickers.

FIG. 19 is a perspective view showing a state where stickers are laminated.

As shown in FIG. 19, a different dot pattern appears each time taking off one strip of the stickers. That is, the power of a character is different after taking off one strip of the stickers. Therefore, these stickers can allow a user to anticipate what kind of power the character would have after taking off the sticker, which interests the user in the game even more.

Figure 20A:
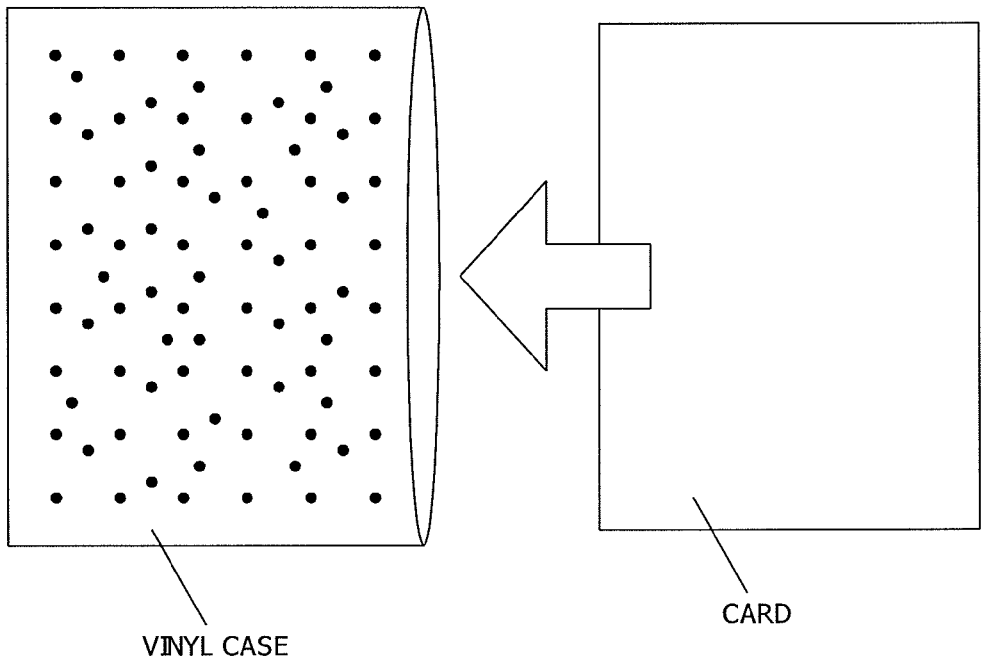
FIGS. 20A and 20B are diagrams illustrating a vinyl case of the present invention (1).
Figure 20B:
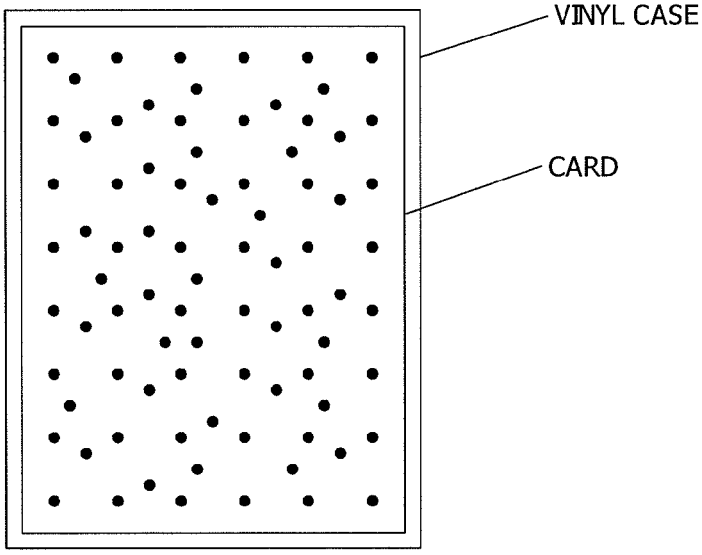

FIGS. 20A and 20B are diagrams illustrating a vinyl case on which a dot pattern is printed. FIG. 20A is a diagram showing the appearance of the vinyl case and use method thereof. FIG. 20B is a diagram showing a state where a card is attached on the vinyl case. A dot pattern is printed on the vinyl case with invisible ink, while no dot pattern is printed on the card. A user operates a game with the card inserted in the vinyl case.

In this embodiment, since parameters of a card can be changed by changing the vinyl case with the one with a different dot pattern, a user can gain a variety of parameters with a single card.

Figure 21A:
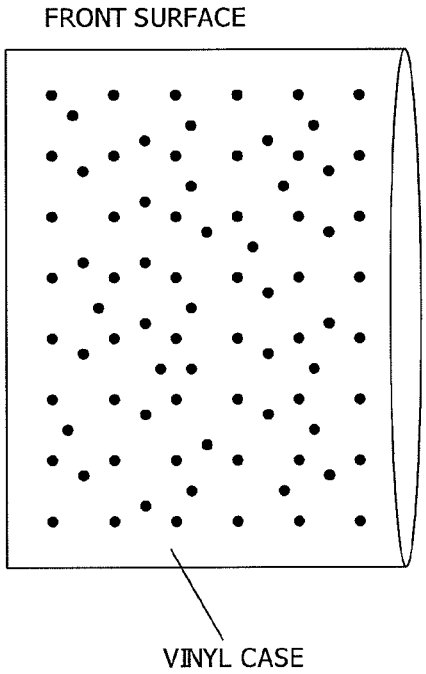
FIGS. 21A and 21B are diagrams illustrating a vinyl case of the present invention (2).
Figure 21B:
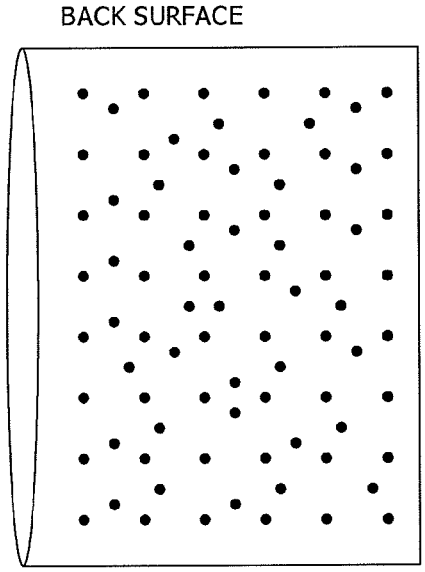

Moreover, as shown in FIGS. 21A and 21B, a dot pattern can be printed on both sides of the vinyl case. With dot patterns printed on both sides, more parameters can be provided with one strip of vinyl seat.

Although the vinyl case on which a dot pattern is printed is described in this embodiment, the present invention is not limited to this. Other material may also be used for the case as long as the container is transparent, has dot patterns formed on one or both sides, and can store the card, such as a hard plastic case. Furthermore, a first dot pattern may be printed on the card, and a second or third dot pattern may be printed on the transparent medium.

Figure 22:
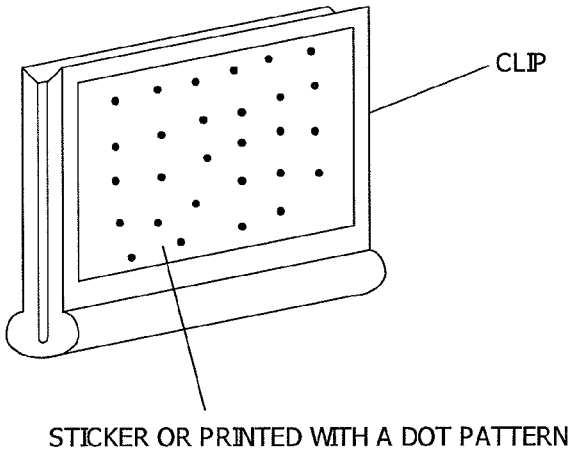
FIG. 22 is a diagram illustrating a clip of the present invention.

FIG. 22 shows that another element attached on the card is a clip holdable of the marginal potion of the card. This clip is configured with a thin plastic. Dot patterns are printed on one side or both front and back sides. Alternatively, a sticker on which a dot pattern is printed may be attached on one side or both front and back sides of the clip. A user attaches a clip on the card and plays a game in that state.

If another element is a sticker, there is a problem that adhesion of a sticker weakens by repeatedly attaching and peeling off, or there is a possibility that, depending on adhesive agent, the adhesive agent remains on a card and the visual quality of the card may be degraded. However, if another element is a clip, repeated attachment and peeling off of the element does not weaken the attachment force, thereby even more convenient repeated use is possible.

If a dot pattern of a clip is formed on a sticker, a plurality of strips of stickers, each provided with a dot pattern, may be laminated.

Next, another embodiment is shown, which changes a dot pattern by peeling off and removing or attaching a sticker which is made with a transparent material and on which a dot pattern is printed.

The sticker is configured with a material transmittable of irradiation light for reading a dot pattern. Dots are disposed on each layer so that a dot pattern obtained from an image of irradiation light captured after transmitting each layer in a state where at least two strips of stickers are laminated means a different value from a dot pattern obtained from an image of irradiation light captured after transmitting each layer in a state where at least one strip of the laminated stickers is peeled off and removed from the laminated stickers.

Alternatively, as shown in FIG. 23A-FIG. 24C, the dot pattern may be made to have different meanings when another sticker is further attached and laminated on one strip of a sticker or two or more strips of laminated stickers.

FIGS. 23A1 to 23A3 are an example of changing a dot pattern by increasing the number of dots. FIG. 23A1 shows a base sticker, that is the first strip of stickers. Opaque or transparent material is used for the base sticker. FIG. 23A2 shows a transparent sticker which has a property to transmit infrared rays. The base sticker and transparent sticker are printed with reference grid point dots and information dots. The reference grid point dots and information dots are printed with infrared ray-absorbing ink. FIG. 23A3 is a diagram showing a state where the transparent sticker is attached over the base sticker. Overlapping the stickers changes the value meant by the dot pattern. Specifically, the dot pattern means 4 in FIG. 23A1; 2 in FIG. 23A2; and 9 in FIG. 23A3.

When printing dots with invisible ink, markers for positioning attachment position should be printed on the base sticker and the transparent sticker. When dots are printed with visible ink, users attach the transparent sticker by matching the reference grid point dots on both stickers. Further, the reference grid point dots may be printed with visible ink and the information dots may be printed with invisible ink.

FIGS. 23B1 to 23B3 are an example where a dot pattern is changed by decreasing the number of dots. This embodiment is characterized by having a mask portion provided with a material which reflects irradiation light on the layer (mask dots), so that when any one of the layers are irradiated with irradiation light, the image of dots disposed on lower layers cannot be captured.

FIG. 23B1 is a diagram showing a base sticker. FIG. 23B2 is a diagram showing a transparent sticker. FIG. 23B3 is a diagram showing a state where the transparent sticker is attached on the base sticker. The transparent sticker is printed with dots (mask dots) with infrared ray-blocking (reflecting) ink. If the mask dots are disposed over dots printed with infrared ray-absorbing ink, dots printed with infrared ray-absorbing ink are hidden and the image of which is not captured by the imaging unit. Therefore, only the image of dots printed with infrared ray-absorbing ink is captured, changing the dot pattern being recognized. Specifically, the dot pattern means 5 in FIG. 23B1. Mask dots are printed in a positive x direction in FIG. 23B2. The dot pattern means 1 in FIG. 23B3 as dots printed in a positive x direction with infrared ray-absorbing ink are hidden and the image of information dots captured is only of the dots in a positive y direction.

FIG. 23C is an example which combines the examples of FIGS. 23A and 23B. That is, the dot pattern is changed by both increasing and decreasing the number of dots. As shown in FIG. 23C1, the information dots on the base sticker means 5. In FIG. 23C2, dots in a negative y direction are printed with infrared ray-absorbing ink and dots printed in a positive x direction are mask dots with infrared ray-blocking (reflecting) ink. If the transparent sticker of FIG. 23C2 is attached over the base sticker of FIG. 23C1, an image of dots in a positive y direction and a negative y direction is captured, the dot pattern, therefore, means 6.

Figure 24A:
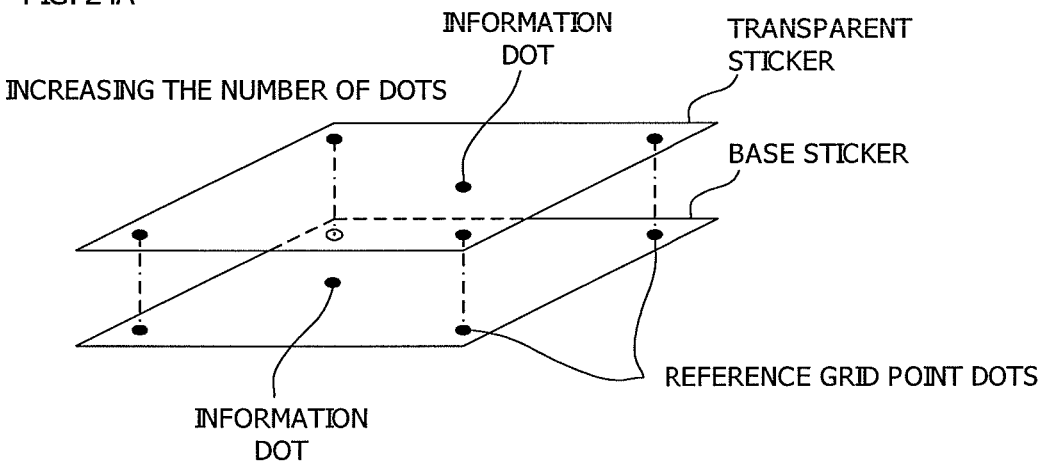
FIGS. 24A to 24C are perspective views how the stickers shown in FIGS. 23A1 to 23C3 are laminated.
Figure 24B:
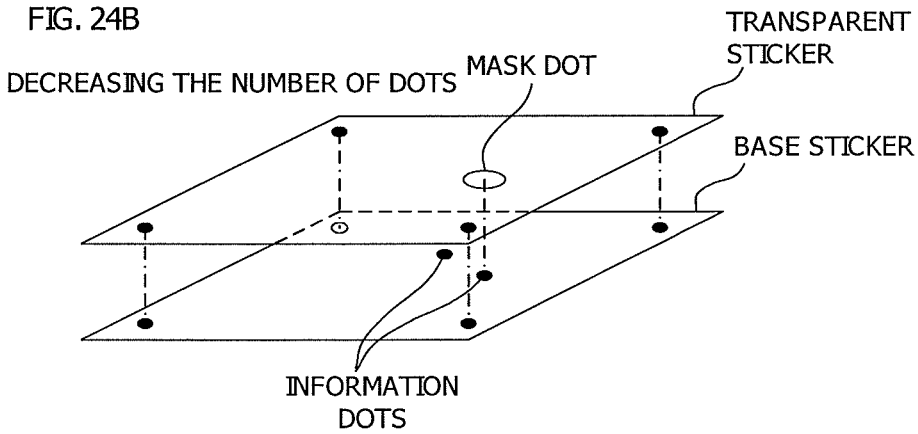
Figure 24C:
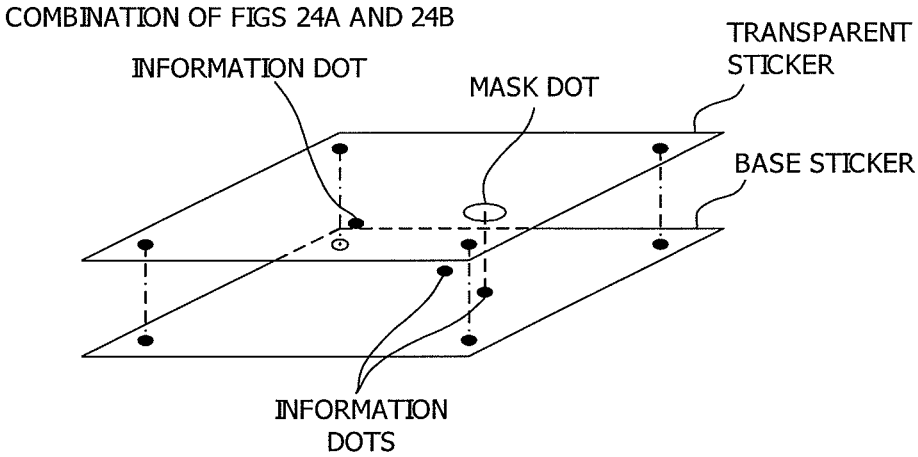

FIGS. 24A to 24C are perspective views showing a state where stickers are laminated as in the example of FIGS. 23A to 23C.

According to FIGS. 24A to 24C, each time peeling off and removing or attaching a sticker, a different dot pattern appears. That is, the power of a character differs when a sticker is peeled off and removed or attached. As such, this sticker can further interest users in the game by having users be anxious to know what kind of power the character would have if a sticker is peeled off and removed or attached.

Figure 25:
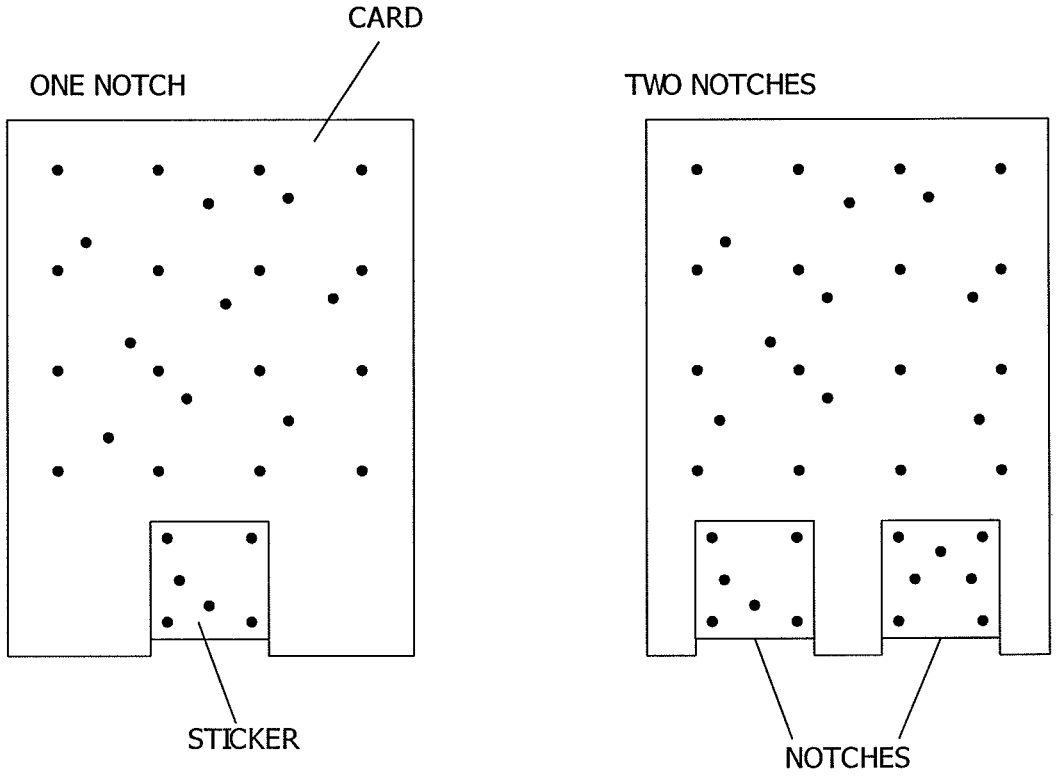
FIG. 25 is a diagram illustrating a card with a notch/notches in the lower portion of the card.

FIG. 25 is a diagram showing another embodiment of the card of this invention. In this embodiment, the edge of the card is provided with a notch for positioning of a sticker upon attachment of the sticker. This card is primarily used when using the sticker shown in FIGS. 16A to 17C. Having such a notch will prevent the sticker from being attached in an irregular position when attaching the sticker in a folded state on the card, thereby allowing the sticker to be attached in an appropriate position.

The notch may be one as shown in FIG. 25A, or two as shown in FIG. 25B. If the sticker shown in FIG. 5 is attached on a card having two notches, the dot pattern combination of two strips of stickers is 256×256=65,536 patterns.

INDUSTRIAL APPLICABILITY

This invention can be used for a card used with card a game machine or the like for industrial use, such as a game center, or for home use.

What is claimed is:

1. A dot pattern printed medium comprising:

a first medium, on at least one surface of which is provided a first dot pattern, in which a coordinate value or a code value is patterned in accordance with a predetermined algorithm;

a second medium which is detachably attached to the first medium and provided with a second dot pattern, in which a coordinate value or a code value which is different from the coordinate value or the code value patterned in the first dot pattern is patterned in accordance with in a predetermined algorithm in a region overlapping with a region where the first dot pattern is provided; and a third medium which is detachably attached to the first medium and the second medium and provided with a third dot pattern, in which a coordinate value or a code value which is different from the coordinate values or the code values patterned in the first dot pattern and the second dot pattern is patterned in accordance with a predetermined algorithm in a region overlapping with a region where the first dot pattern is provided and a region where the second dot pattern is provided, wherein the second medium is a sticker, and the second dot pattern or the third dot pattern is formed on at least part of the sticker, and the sticker is attached to a card along the edge of the card in a manner such that the sticker is foldable in both front and back surface directions of the card.

2. The dot pattern printed medium as claimed in claim 1, wherein at least the first dot pattern is formed by being printed on a whole or a part of the one surface of the first medium.

3. The dot pattern printed medium as claimed in claim 1, wherein the sticker is formed by laminating a plurality of strips of stickers, each of which has a dot pattern provided thereon.

4. A dot pattern printed medium comprising:

a first medium, on at least one surface of which is provided a first dot pattern, in which a coordinate value or a code value is patterned in accordance with a predetermined algorithm;

a second medium which is detachably attached to the first medium and provided with a second dot pattern, in which a coordinate value or a code value which is different from the coordinate value or the code value patterned in the first dot pattern is patterned in accordance with a predetermined algorithm in a region overlapping with a region where the first dot pattern is provided; and a third medium which is detachably attached to the first medium and the second medium and provided with a third dot pattern, in which a coordinate value or a code value which is different from the coordinate values or the code values patterned in the first dot pattern and the second dot pattern is patterned in accordance with a predetermined algorithm in a region overlapping with a region where the first dot pattern is provided and a region where the second dot pattern is provided, wherein the second medium or the third medium is capable of storing the first medium and has a transparent body on one surface of which the second dot pattern or the third dot pattern is formed.

5. The dot pattern printed medium as claimed in claim 4, wherein different values are made into patterns as dot patterns between a side of the transparent body that faces the front surface of a card and a side thereof that faces the back surface of the card.

6. A dot pattern printed medium comprising:

a first medium, on at least one surface of which is provided a first dot pattern, in which a coordinate value or a code value is patterned in accordance with a predetermined algorithm;

a second medium which is detachably attached to the first medium and provided with a second dot pattern, in which a coordinate value or a code value which is different from the coordinate value or the code value patterned in the first dot pattern is patterned in accordance with a predetermined algorithm in a region overlapping with a region where the first dot pattern is provided; and a third medium which is detachably attached to the first medium and the second medium and provided with a third dot pattern, in which a coordinate value or a code value which is different from the coordinate values or the code values patterned in the first dot pattern and the second dot pattern is patterned in accordance with a predetermined algorithm in a region overlapping with a region where the first dot pattern is provided and a region where the second dot pattern is provided, wherein the second medium or the third medium is a clip capable of holding a an edge of a card, and the second dot pattern or the third dot pattern is formed on at least part of a surface of the clip.

7. The dot pattern printed medium as claimed in claim 6, wherein dot patterns of different values are formed respectively on front and back surfaces of the clip.

8. The dot pattern printed medium as claimed in claim 6, wherein the second dot pattern or the third dot pattern of the clip is formed on a sticker attached on a surface of the clip.

9. The dot pattern printed medium as claimed in claim 8, wherein the sticker is formed by laminating a plurality of strips of stickers, each of which has a dot pattern provided thereon.

10. The dot pattern printed medium as claimed in claim 9, wherein each layer of the laminated stickers has a dot pattern thereon in a manner such that an image of a dot pattern captured in a laminated state and an image of a dot pattern captured in a state where at least one strip is peeled and removed from the laminated stickers signify different values.

11. The dot pattern printed medium as claimed in claim 10, wherein the sticker is formed with a material which reflects irradiation light for reading a dot pattern off the layer, and each sticker constituting each layer of the laminated stickers has a dot pattern of a different value that is formed with a material which absorbs the irradiation light.

12. The dot pattern printed medium as claimed in claim 1, wherein a notch is provided on an edge of the card for positioning the sticker when attaching the sticker thereon.

13. A card comprising:

a first dot pattern in which a coordinate value or a code value is patterned in accordance with a predetermined algorithm on at least one surface of the card; and a second dot pattern, in which a coordinate value or a code value which is different from the coordinate value or the code value patterned in the first dot pattern is patterned in a predetermined algorithm in a region overlapping with or a region different from a region where the first dot pattern is provided, wherein the second dot pattern is formed on a sticker attachable to and detachable from the card, the sticker is attached in a foldable state along an edge of the card in both front and back surface directions of the card, an adhesive layer is formed on one surface of the sticker, the adhesive layer is divided into a strong adhesive region and a weak adhesive region with a folding line as a border, and the sticker is interposed by a peel-off liner on each adhesive region in a folded state before attached on the card, wherein upon peeling off the sticker from the peel-off liner, peeling off from one surface of the peel-off liner completes in a state where the peel-off liner remains attached only on the strong adhesive region of the sticker, the weak adhesive region of the sticker exposed in this one surface peeled-off state is attached on the front or back surface of the card, and after peeling off the peel-off liner from the strong adhesive region, the sticker is folded along the edge of the card and the strong adhesive region is attached on the back or front surface of the card.

14. A card comprising:

a first dot pattern in which a coordinate value or a code value is patterned in accordance with a predetermined algorithm on at least one surface of the card; and a second dot pattern, in which a coordinate value or a code value which is different from the coordinate value or the code value patterned in the first dot pattern is patterned in a predetermined algorithm in a region overlapping or a region different from a region where the first dot pattern is provided;

wherein the second dot pattern is formed on a sticker attachable to and detachable from the card, the sticker is attached in a foldable state along an edge of the card in both front and back surface directions of the card, an adhesive layer is formed on one surface of the sticker, the adhesive layer is divided into equal adhesive regions with a folding line as a border, the sticker is interposed by a peel-off liner on each adhesive region in a folded state before being attached on the card, and front and back surfaces of the peel-off liner are different in peel force, wherein upon peeling the sticker from the peel-off liner, peeling off from one surface of the peel-off liner completes in a state where only a weak peel force (strong adhesive) surface of the peel-off liner remains attached on the sticker, the adhesive region of the sticker exposed in this one surface peeled-off state is attached on the front or back surface of the card, and after peeling off the remained weak peel force surface of the peel-off liner from the sticker the sticker is folded along the edge of the card and the exposed adhesive region is attached on the back or front surface of the card.

15. The dot pattern printed medium as claimed in claim 1, further comprising a mask portion, on any one layer of the laminated stickers, formed with a material which reflects irradiation light for reading the dot pattern off the layer, so that dots disposed on lower layers are not imaged when irradiated with the irradiation light.

16. The dot pattern printed medium as claimed in claim 3, wherein the sticker is formed with a material which reflects irradiation light for reading a dot pattern off the layer, and each sticker constituting each layer of the laminated stickers has a dot pattern of a different value that is formed with a material which absorbs the irradiation light.

17. The card as claimed in claim 13, wherein a third dot pattern, in which a coordinate value or a code value which is different from the coordinate value or the code value patterned in the first dot pattern and the second dot pattern is patterned in a predetermined algorithm in a region overlapping with a region where the first dot pattern and the second dot pattern are provided.

18. The card as claimed in claim 14, wherein a third dot pattern, in which a coordinate value or a code value which is different from the coordinate value or the code value patterned in the first dot pattern and the second dot pattern is patterned in a predetermined algorithm in a region overlapping with a region where the first dot pattern and the second dot pattern are provided.

19. A dot pattern printed medium formed by laminating a plurality of strips of stickers, each of which has a dot pattern in which a coordinate value or a code value is patterned in accordance with a predetermined algorithm, wherein the laminated stickers comprise: a base sticker disposed at a lower layer; and one or a plurality of transparent stickers disposed at upper layers, the transparent stickers are formed with a material which transmits irradiation light for reading the dot pattern, a dot pattern to be imaged is a dot pattern formed by combining dots printed on the base sticker and dots printed on the transparent stickers of respective layers, and an image of a dot pattern captured in a laminated state and an image of a dot pattern captured in a state where at least one strip is peeled and removed from the laminated stickers signify different values.

20. A dot pattern printed medium formed by laminating a plurality of strips of stickers, each of which has a dot pattern in which a coordinate value or a code value is patterned in accordance with a predetermined algorithm, wherein the laminated stickers comprise: a base sticker disposed at a lower layer; and one or a plurality of transparent stickers disposed at upper layers, the transparent stickers are formed with a material which transmits irradiation light for reading the dot pattern, a dot pattern to be imaged is a dot pattern formed by combining dots printed on the base sticker and dots printed on the transparent stickers of respective layers, and an image of a dot pattern captured only with the base sticker or in a laminated state and an image of a dot pattern captured in a state where a transparent sticker is further attached thereon signify different values.

21. The dot pattern printed medium as claimed in claim 19, further comprising a mask portion, on any one layer of the laminated stickers, made with a material which reflects irradiation light off the layer, so that dots disposed on lower layers are not imaged when irradiated with the irradiation light.

22. A dot pattern printed medium formed by laminating a plurality of strips of stickers, each of which has a dot pattern in which a coordinate value or a code value is patterned in accordance with a predetermined algorithm, wherein the dot pattern of each layer comprises: a plurality of reference grid point dots arranged in a rectangle shape; and an information dot which defines information, the reference grid point dots are printed at the same positions on all the stickers, while the information dot is printed at a different position on each sticker, a dot pattern in a laminated state and a dot pattern in a state where at least one strip is peeled and removed from the laminated stickers are imaged within a same area, and the dot pattern is formed on each layer so that the dot pattern in the laminated state and the dot pattern in the state where at least one strip is peeled and removed from the laminated stickers signify different values.

23. The dot pattern printed medium as claimed in claim 20, further comprising a mask portion, on any one layer of the laminated stickers, made with a material which reflects irradiation light off the layer, so that dots disposed on lower layers are not imaged when irradiated with the irradiation light.

* * * * *